US009303211B2

(12) United States Patent
Simpson et al.

(10) Patent No.: US 9,303,211 B2
(45) Date of Patent: Apr. 5, 2016

(54) BITUMEN EXTRACTION AND DEWATERING IN A FILTER PRESS

(75) Inventors: Daniel J. Simpson, Rio Vista, CA (US); Ferdinand Kogler, Rio Vista, CA (US)

(73) Assignee: Daniel J. Simpson, Rio Vista, CA (US)

( * ) Notice: Subject to any disclaimer, the term of this patent is extended or adjusted under 35 U.S.C. 154(b) by 0 days.

(21) Appl. No.: 13/525,043

(22) Filed: Jun. 15, 2012

(65) Prior Publication Data

US 2012/0318718 A1 Dec. 20, 2012

Related U.S. Application Data

(60) Provisional application No. 61/498,979, filed on Jun. 20, 2011.

(51) Int. Cl.

| | |
|---|---|
| ***C10G 1/04*** | (2006.01) |
| ***C10G 1/00*** | (2006.01) |
| ***C10G 31/09*** | (2006.01) |

(52) U.S. Cl.

CPC .. *C10G 1/00* (2013.01); *C10G 1/04* (2013.01); *C10G 1/045* (2013.01); *C10G 1/047* (2013.01); *C10G 31/09* (2013.01); *C10G 2300/1033* (2013.01); *C10G 2300/44* (2013.01); *C10G 2300/807* (2013.01)

(58) Field of Classification Search

CPC ..... C10G 1/00; C10G 1/047; C10G 1/045; C10G 31/09; C10G 1/04; C10G 2300/1033; C10G 2300/44; C10G 2300/807

USPC ..... 208/390–391

See application file for complete search history.

(56) References Cited

U.S. PATENT DOCUMENTS

| | | | | | |
|---|---|---|---|---|---|
| 1,722,497 | A | * | 7/1929 | Foster | 210/224 |
| 4,108,777 | A | | 8/1978 | Kurita et al. | |
| 4,222,873 | A | * | 9/1980 | Parsons | 210/777 |
| 4,240,897 | A | * | 12/1980 | Clarke | 208/425 |
| 4,482,459 | A | | 11/1984 | Shiver | |
| 4,544,490 | A | | 10/1985 | Erickson et al. | |
| 4,617,863 | A | | 10/1986 | Kenyon | |
| 4,740,413 | A | | 4/1988 | Wildner | |

(Continued)

FOREIGN PATENT DOCUMENTS

| | | | |
|---|---|---|---|
| EP | 0062543 A1 | | 10/1982 |
| WO | WO 97/00171 | * | 1/1997 |
| WO | WO97/00171 | | 1/1997 |

OTHER PUBLICATIONS http://www.oilsands.ualberta.ca.*

(Continued)

*Primary Examiner* — Randy Boyer
*Assistant Examiner* — Juan Valencia
(74) *Attorney, Agent, or Firm* — David H. Jaffer; Pillsbury Winthrop Shaw Pittman LLP

(57) ABSTRACT

A process for extraction of bitumen and other oil products from sand, other sedimentary deposits and from mine tailings, may comprise flowing solvent through these bitumen-containing materials held in a filter press, where elevated pressures and temperatures may be used. After exposure to solvent the sedimentary deposits may be exposed to hot water, steam and/or vacuum to remove residual solvents. Further embodiments of the bitumen extraction process may include substituting the solvent with hot water or steam. Filter press systems for extracting bitumen are also described.

33 Claims, 13 Drawing Sheets

(56) References Cited

U.S. PATENT DOCUMENTS

| | | | | |
|---|---|---|---|---|
| 4,839,045 | A | 6/1989 | Wildner | |
| 4,981,579 | A * | 1/1991 | Paspek et al. | 208/314 |
| 4,995,972 | A | 2/1991 | Kramer et al. | |
| 5,087,375 | A | 2/1992 | Weinwurm | |
| 5,672,272 | A | 9/1997 | Baer | |
| 6,149,806 | A | 11/2000 | Baer | |
| 6,180,002 | B1 | 1/2001 | Higgins | |
| 6,214,213 | B1 * | 4/2001 | Tipman et al. | 208/390 |
| 6,280,638 | B1 | 8/2001 | Belchev | |
| D452,295 | S | 12/2001 | Ricketts | |
| 6,689,925 | B2 | 2/2004 | Malhis | |
| 7,097,761 | B2 | 8/2006 | Kresnyak | |
| 7,309,408 | B2 | 12/2007 | Benavides | |
| 7,422,680 | B2 | 9/2008 | Sheets, Sr. | |
| 2001/0021428 | A1 | 9/2001 | Simpson et al. | |
| 2003/0023149 | A1 | 1/2003 | Montemagno et al. | |
| 2003/0083532 | A1 | 5/2003 | Malhis | |
| 2004/0149649 | A1 | 8/2004 | Uchiyama | |
| 2005/0194292 | A1 * | 9/2005 | Beetge et al. | 208/391 |
| 2006/0032805 | A1 | 2/2006 | Hildebrant et al. | |
| 2006/0131224 | A1 | 6/2006 | Hibble | |
| 2007/0084781 | A1 | 4/2007 | Hornback et al. | |
| 2007/0125693 | A1 | 6/2007 | Lindley | |
| 2008/0190831 | A1 | 8/2008 | Marchek | |
| 2008/0210467 | A1 | 9/2008 | Eia | |
| 2009/0263755 | A1 * | 10/2009 | Nigro et al. | 431/202 |
| 2010/0011675 | A1 * | 1/2010 | Creech | 52/62 |
| 2010/0116755 | A1 * | 5/2010 | Simpson et al. | 210/748.07 |
| 2011/0180458 | A1 * | 7/2011 | Duyvesteyn et al. | 208/391 |
| 2011/0186417 | A1 | 8/2011 | Simpson et al. | |
| 2011/0203999 | A1 | 8/2011 | Simpson et al. | |

OTHER PUBLICATIONS

International Search Report and Written Opinion Issued Nov. 6, 2012 for PCT/US2012/042799.

*Drilling Waste Management Technology Descriptions*, see: http://web.ead.anl.gov/dwm/techdesc/index.cfm last viewed May 24, 2010.

Devenny, D.W., "Part B Report: Overview of Oil Sand Tailings," Alberta Energy Research Institute, Contract 2008 0326, May 2009, 76 pgs.

* cited by examiner

Process Flow for Bitumen Extraction using Solvent in a Filter Press

Process Flow for Bitumen Extraction using Hot Water/Steam in a Filter Press

SECTION N-N

SECTION Y-Y

SECTION Z-Z

BITUMEN EXTRACTION AND DEWATERING IN A FILTER PRESS

CROSS-REFERENCE TO RELATED APPLICATIONS

This application claims the benefit of U.S. Provisional Application No. 61/498,979 filed Jun. 20, 2011, incorporated herein by reference in its entirety.

FIELD OF THE INVENTION

The invention relates to systems and methods for extraction of bitumen and other oil-based substances from sedimentary deposits in filter presses, and to systems and methods for water removal from fluid tailings, including mature fine tails, which are a product of the bitumen extraction process.

BACKGROUND OF THE INVENTION

Naturally occurring or crude bitumen is a sticky, tar-like form of petroleum that is so thick and heavy that it must be heated or diluted before it will flow. Bituminous sands, also known as oil sands or tar sands, are a type of petroleum deposit. Bituminous sands generally contain sand, clay, water, and crude bitumen. Bituminous sands are found in large deposits in many countries, although most notably in Canada—for example, the Athabasca Oil Sands in the province of Alberta—and Venezuela.

Bituminous sands are important as a source of oil. The bituminous sands may be extracted by strip mining or made to flow into wells by processes that reduce the viscosity of the bitumen by injecting steam or solvents into the bituminous sands deposit.

The most significant Canadian bituminous sands deposits are located in the province of Alberta: Athabasca, Cold Lake and Peace River. Between them these deposits cover over 50,000 square miles and hold reserves estimated to be approaching 2 trillion barrels of bitumen. More than 10% of this is estimated to be recoverable at current oil prices, which makes it by far the largest oil reserve in North America, and one of the largest in the world.

The largest bitumen deposit—the Athabasca deposit—comprises an area in excess of 1,000 square miles and is suitable for surface mining. The smaller Cold Lake deposits comprise some oil with a viscosity that is low enough to be extracted by conventional fluid oil extraction methods. All three bitumen deposits in Alberta are suitable for production using methods such as steam assisted gravity drainage (SAGD), described in more detail below.

In the Athabasca oil sands there are very large amounts of bitumen rich deposits covered by only a small amount of overburden, making surface mining the most efficient method of extracting the bitumen. The overburden consists of peat bog over clay and sand. The oil sands themselves are typically 40 to 60 meters deep, sitting on top of flat limestone rock. The bituminous sands are mined with power shovels and dump trucks. After excavation, hot water and caustic soda are added to crushed bituminous sand, and the resulting slurry is piped to an extraction plant where bitumen is removed. Provided that the water chemistry is appropriate to allow bitumen to separate from sand and clay, the combination of hot water and agitation releases bitumen from the oil sand, and allows small air bubbles to attach to the bitumen droplets. The bitumen froth floats to the top of separation vessels, and is further treated to remove residual water and fine solids. Bitumen is much thicker than traditional crude oil, so it must be either mixed with lighter petroleum (either liquid or gas) or chemically cracked before it can be transported by pipeline for upgrading into synthetic crude oil.

About two tons of oil sands are required to produce one barrel of oil. Originally, roughly 75% of the bitumen was recovered from the sand. However, recent enhancements to extraction methods including recovery of residual bitumen in the tailings and recovery of diluent from the froth allow for recovery of over 90% of the bitumen in the bituminous sand deposit.

Tailings in the context of oil sands mining are the residues separated out at various stages in the extraction of oil-based material from the bitumen bearing sedimentary deposits. A diluent is a lower density fluid mixed with bitumen or heavy crude to reduce the viscosity and density. Diluents are often mixed with heavy crude to allow transportation by pipeline. A common diluent used in the tar sand oil industry is natural gas condensate, which is a mixture of pentanes and heavier hydrocarbon liquids extracted from natural gas. C5 is an example of a natural gas condensate.

More details of the commercial extraction of bitumen from the tar sands are provided in FIG. 1. See D. W. Devenny, Part B Report Overview of Oil Sands Tailings Report, Figure B.12, pg. 21, http://eipa.alberta.ca/media/40994/oil%20sands%20tailings%20treatment %20technologies%20-%20final%20report%20-%20part%20b.pdf, last visited May 31, 2011. An example of extraction of the bitumen proceeds according to the following general process flow: (1) mine the bitumen containing sedimentary deposit; (2) crush the mined material; (3) form a slurry of water and crushed material; (4) pass the slurry through a coarse screen; (5) transport the slurry to an extraction plant—this hydrotransport process is also important in conditioning the slurry by separating ore particles from each other; (6) add extra water to the slurry; (7) (a) remove sand by allowing the sand to settle in a primary separation vessel (PSV) and send the sand to tailings, (b) bitumen, aided by small air bubbles, floats to the surface in the tank, forming a froth, which is removed and sent on to froth cleaning, and (c) the mixture left in the PSV, containing water, silt, clay and small amounts of bitumen is sent to middlings treatment; (8) the middlings treatment involves (a) injecting air to aid in removal of some of the remaining bitumen by forming a bitumen froth on the surface of the treatment tank, (b) collecting the froth and recycling to the PSV, and (c) sending the residual fluid to tailings; (9) bitumen containing froth is subject to (a) treatment with solvents, such as naptha, followed by (b) separation processes, such as centrifuging, to separate the bitumen from the remaining water and solids, mainly clays, and (c) the bitumen is retained for refining and (d) the separated water and solids are sent to tailings. When all of the tailings are combined, the volume of slurry exiting the extraction plant is approximately twice that of the ore containing slurry that entered the plant, and these tailings contain unrecovered bitumen, which may approach up to 10% by weight of the total bitumen content of the sedimentary deposit. Furthermore, some of the tailings currently stored in ponds, which date back to when the extraction processes were not as efficient as today, may contain more than 10% by weight of the total bitumen content of the sedimentary deposit.

After bitumen extraction, the tailings must be returned to the mine for reclamation of the land. However, currently a large fraction of the tailings have not yet been used for land reclamation—in particular the more fluid tailings, including mature fine tailings (MFTs), are stored in large tailings ponds and have proved to be very difficult to use in reclamation. MFTs are partially densified deposits formed from waste slurry from the bitumen extraction process which has a density of fine particles, primarily clay, of approximately 30%—the point at which repulsive forces between clay particles prevents further densification.

In 2009 the Canadian Energy Resources Conservation Board (ERCB) issued a directive requiring oil sand mine operators to annually increase the amounts of fluid tailings that are solidified—in order to reduce the amount of fluid tailings that are stored long-term, and to aid in increasing the rate at which the mining sites are reclaimed. In order to be suitable for reclamation the solidified tailings need to be trafficable—able to remain stable under heavy vehicle traffic, which can be quantified by a minimum undrained shear strength of 10 kPa. (This equates roughly to MFTs with a percentage weight of water reduced below 25%.) See D. W. Devenny, Part B Report Overview of Oil Sands Tailings Report, Figure B.23, pg. 36. Processing of fluid tailings to produce trafficable solids requires an efficient method of water removal from the tailings. Furthermore, water removal at earlier points in the slurry processing—during the bitumen extraction process—helps to increase the amount of fines that can be captured by sand, and thus do not end up as mature fine tails.

Clearly, there is a need for efficient methods and equipment for recovery of bitumen from sedimentary deposits and for efficient methods and equipment for dewatering of the more fluid tailings, including mature fine tails.

Open caste mining is not used when the deposits are too deep. However, other techniques may be used, some of which are described below.

Cold heavy oil production with sand (CHOPS) is a process in which oil is pumped out of the sand deposits using pumps such as progressive cavity pumps. CHOPS recovers typically around 10% of the oil from the tar sand deposits of Alberta, Calif. A large amount of sand is pumped with the oil to get the best oil recovery rates, with the disadvantage of having to dispose of the oily sand. The sand has been used to make road surfaces in parts of Canada. However, there are concerns over the effect of the residual oil on the environment, and alternative methods of disposing of or cleaning up the oily sand are needed.

Clearly, there is a need for efficient methods and equipment for recovery of oil from the oily sand left over after CHOPS, and for providing clean sand that does not pose an environmental hazard.

Steam assisted gravity drainage (SAGD) involves drilling two horizontal wells in the oil sands, one at the bottom of the bituminous sands formation and a second approximately 5 meters above it. These wells are drilled in groups from a central drilling platform and can extend for miles in all directions. In each pair of wells, steam is injected into the upper well to melt the bitumen. The bitumen flows down to the lower well and is pumped to the surface. SAGD allows high oil production rates, recovering up to 70% of the oil from the deposit and is widely used in Alberta's oil sands areas. However, the oil/water mixture that is pumped to the surface contains a large amount of suspended solids that must be removed and disposed of.

Clearly, there is a need for efficient methods and equipment for removing the suspended solids from the oil/water mixture produced by SAGD, and for providing the suspended solids in a clean form that does not pose an environmental hazard.

SUMMARY OF THE INVENTION

A process for extraction of bitumen and other oil products from sand, other sedimentary deposits and from mine tailings, may comprise flowing solvents through these bitumen-containing materials held in a filter press, where elevated pressures and temperatures may be used. The filter plates are made of cross-linked polyethylene or similar material which can withstand exposure to solvents under these conditions. The filter cloths must also withstand these conditions—suitable candidates may include polypropylene, Teflon®, polyester, etc. and even stainless steel mesh. After exposure to solvent(s) the sedimentary deposits may be exposed to water (hot liquid water or steam) and vacuum to remove residual solvents; a flare may be used on the exhaust from the vacuum pump to burn off volatile hydrocarbons which have not been condensed out. Suitable solvents include diluents such as natural gas condensate (which is a by-product of oil production from crude bitumen), pentanes, C5, other carbon-based solvents, etc. which are supplied to the filter press at a temperature below the evaporation point—typically around 40° C. for condensate. The solvent may be delivered to the chambers of the filter press through the feed ports, the filtrate ports, etc. Furthermore, the solvent may be mixed with the bitumen-containing materials as the latter is being pumped into the filter press, or even immediately prior to pumping into the filter press.

Further embodiments of the bitumen extraction process may include substituting the solvent with: (1) boiling hot water (free boiling-100° C.); and (2) steam at a pressure of 15 psi (approximately 250° F.), for example. The materials that can be used for the filter plates may be less restricted when solvents are not used. The solvent-free method works for certain types of bitumen deposits—being effective in removing the bitumen and associated oil-based materials—and is advantageous in reducing emissions of solvent vapors from the filter press during the process. More specifically, the water-based extraction process works well when the predominant material from which the bitumen is being separated has a greater affinity for water than for oil—for example, sand particles comprised of quartz are not readily coated with bitumen and the bitumen can readily be separated from the sand using a hot water process.

The bitumen-containing materials may be provided to the filter press as a slurry, and the slurry may be pre-heated. (In embodiments in which some stages of bitumen extraction have already occurred, the slurry may be hot due to processing and may be provided to the filter press hot, thus making the processes in the filter press which include heating much more energy efficient. Furthermore, separating out hot water in the filter press and returning it to the process facility for reuse will significantly reduce the amount of heat lost from the bitumen process facility.) The slurry comprising bitumen-containing materials may be formed by crushing the sedimentary deposits and combining with water. In other embodiments, the slurry may comprise mine tailings—the slurry comprises sedimentary deposits that have already been pre-processed for removal of most of the bitumen and other oil-based materials. Slurry from various different stages of processing may be directed to a filter press for processing according to the present invention.

According to aspects of the invention, a method of extracting bitumen from a bitumen-containing sedimentary material using organic solvents may comprise: providing a slurry of bitumen-containing sedimentary material; pumping the slurry into a chamber between two filter plates in a filter press to form a filter cake, wherein the chamber is lined by filter cloths, and wherein, during the pumping, filtrate is forced through the filter cloths and out of the chamber; and pumping solvents through the filter cake to dissolve the bitumen and carry it away in the effluent. The process may further include heating the filter cake in the chamber, during said pumping solvents. During the heating and pumping solvents, the chamber may be exposed to a vacuum. During vacuum processing a flare may be ignited on the exhaust of the vacuum pump to burn-off flammable vapors. After exposure to solvents the filter cake may be exposed to water and vacuum for removal of residual solvents prior to release of the filter cake from the filter press, wherein the water may be hot liquid water or steam. The slurry may comprise mine tailings. The process may further include applying pressure and/or heat to the filter cake in the chamber during said pumping solvents, said applying pressure and/or heat being by inflating envelopes in said filter plates using steam or compressed gas. Alternative process flows may have the solvent mixed with the slurry immediately before, or as, it is pumped into the filter press. Furthermore, solvent may be added at different times during processing of the same filter cake—for example, during pumping into the filter press and/or during application of vacuum.

According to a further embodiment, a method of extracting bitumen from a bitumen-containing sedimentary material using water may comprise: providing a slurry of bitumen-containing sedimentary material; pumping the slurry into a chamber between two filter plates in a filter press to form a filter cake, wherein the chamber is lined by filter cloths, and wherein, during the pumping, filtrate is forced through the filter cloths and out of the chamber; and pumping water through the filter cake to dissolve the bitumen and carry it away in the effluent. Wherein the water may be hot liquid water, freely boiling water, or steam, at a pressure of roughly 15 psi or greater. Furthermore, the oil-based substances released from the tailings may be separated from water in the effluent—a separation tank may be used for this process. The process may further include applying pressure and/or heat to the filter cake in the chamber during said pumping water, said applying pressure and/or heat being by inflating envelopes in said filter plates using steam or compressed gas. The slurry may comprise mine tailings. Alternative process flows may have the hot water/steam mixed with the slurry immediately before, or as, it is pumped into the filter press. Furthermore, hot water/steam may be added at different times during processing of the same filter cake—for example, during pumping into the filter press and/or during application of vacuum.

According to aspects of the invention, a method of extracting bitumen from mine tailings in a filter press may comprise: providing a water-based slurry including tailings; pumping the slurry into a chamber between two filter plates in the filter press to form a filter cake, wherein the chamber is lined by filter cloths, and wherein, during the pumping, filtrate is forced through the filter cloths and out of the chamber; separating residual bitumen from water in an oil/water separator; heating the filter cake in the chamber, wherein, during the heating, filtrate is forced through the filter cloths and out of the chamber; and releasing dried filter cake from said chamber. During the heating, the chamber may be vacuum pumped to facilitate removal of filtrate vapor. During vacuum processing a flare may be ignited on the exhaust of the vacuum pump to burn-off flammable vapors. The heating may be by steam applied to envelopes in the filter plates. The process may further include applying pressure to the filter cake in the chamber during said heating, said applying pressure being by inflating the envelopes in the filter plates using steam or compressed gas. The slurry may include MFTs. The method may further comprise adding a flocculating/coagulating agent and stirring to form a chemically processed solids-enriched slurry, before pumping the slurry into the filter press. The method may further comprise pumping water/solvent through the filter cake to dissolve the bitumen and carry it away in the effluent. Furthermore, the oil-based substances released from the tailings may be separated from water in the filtrate—a separation tank may be used for this process. Yet furthermore, this process may also be applied to a slurry of the crushed mined deposit, rather than just to the tailings.

According to aspects of the invention, a method of extracting bitumen from solids-enriched mine tailings in a filter press may comprise: providing a water-based slurry including the tailings; adding additional solids to the slurry to form a solids-enriched mixture; pumping the solids-enriched mixture into a chamber between two filter plates in the filter press to form a filter cake, wherein the chamber is lined by filter cloths, and wherein, during the pumping, filtrate is forced through the filter cloths and out of the chamber; heating the filter cake in the chamber, wherein, during the heating, filtrate is forced through the filter cloths and out of the chamber; and releasing dried filter cake from said chamber. The heating may be by steam applied to envelopes in the filter plates. During the heating, the chamber may be vacuum pumped to facilitate removal of filtrate vapor. During vacuum processing a flare may be ignited on the exhaust of the vacuum pump to burn-off flammable vapors. The mixture may include MFTs and the additional solids may be overburden from the mine, wherein the overburden may contain sand and/or dry "swelling" clay. Furthermore, additional solids may comprise paper pulp. The method may further comprise diluting the solids-enriched mixture, adding a flocculating agent and stirring to form a chemically processed solids-enriched mixture, before pumping the mixture into the filter press. The process may further include applying pressure to the filter cake in the chamber during said pumping, said applying pressure being by inflating envelopes in said filter plates using steam or compressed gas.

According to further aspects of the invention, a filter press system for extracting bitumen from a slurry including bitumen-containing sedimentary deposits may comprise: a frame; a plurality of filter plates configured to form a stack of parallel plates, each of the plurality of filter plates being movably attached to the frame, the plurality of filter plates further being configured to form a multiplicity of chambers, each of the multiplicity of chambers being formed by adjacent filter plates of the plurality of filter plates, each of the multiplicity of chambers being lined by filter cloths, wherein the plurality of filter plates, the multiplicity of chambers and the filter cloths are configured to allow filtrate to escape from the chambers while retaining solids from the slurry to form a filter cake; and a heater for heating filter cake in the multiplicity of chambers; wherein said filter plates are formed of polymers that can withstand prolonged exposure to hot solvents, such as natural gas condensate at a temperature of 45° C. (Note that higher temperatures may be tolerated when vacuum is applied.) Furthermore, a vacuum pump may be connected to the multiplicity of chambers to assist in removal of excess solvents from the filter cake in the chambers. A flare system may be attached to the exhaust of the vacuum pump for burning-off flammable vapors, particularly flammable vapors generated during vacuum processing. Yet furthermore, the filter plates may be configured with envelopes for applying pressure and/or heat to the filter cake in the chamber during said extraction, said applying pressure and/or heat being by inflating envelopes in said filter plates using steam or compressed gas.

According to further aspects of the invention, a filter press system for adding solids to and extracting bitumen from a slurry including bitumen-containing sedimentary deposits may comprise: a frame; a plurality of filter plates configured to form a stack of parallel plates, each of the plurality of filter plates being movably attached to the frame, the plurality of filter plates further being configured to form a multiplicity of chambers, each of the multiplicity of chambers being formed by adjacent filter plates of the plurality of filter plates, each of the multiplicity of chambers being lined by filter cloths, wherein the plurality of filter plates, the multiplicity of chambers and the filter cloths are configured to allow filtrate to escape from the chambers while retaining solids from the slurry to form a filter cake; a mixing vessel configured to mix additional solids, such as overburden, into the mixture to form a solids-enriched slurry; a transfer mechanism for moving the solids-enriched slurry from the mixing vessel to the multiplicity of chambers; and a heater for heating filter cake in the multiplicity of chambers. The mixing vessel may be an elongated drum rotatable about its longitudinal axis, the longitudinal axis being at roughly 45 degrees to the horizontal—an example of a suitable mixing vessel being a cement mixer. Furthermore, a vacuum pump may be connected to the multiplicity of chambers to assist in removal of filtrate from the filter cake in the chambers. A flare system may be attached to the exhaust of the vacuum pump for burning-off flammable vapors, particularly flammable vapors generated during vacuum processing. Yet furthermore, the filter plates may be configured with envelopes for applying pressure and/or heat to the filter cake in the chamber during said extraction, said applying pressure and/or heat being by inflating envelopes in said filter plates using steam or compressed gas.

Furthermore, note that the above described methods and systems for extracting bitumen from a slurry including bitumen-containing sedimentary material include a dewatering of the slurry. The above methods and systems may be applied simply for dewatering slurries, including MFTs from oil sands mining and mining in general. For example, according to further aspects of the invention, a method of dewatering mine tailings in a filter press may comprise: providing a water-based slurry including mine tailings; pumping the slurry into a chamber between two filter plates in the filter press to form a filter cake, wherein the chamber is lined by filter cloths, and wherein, during the pumping, filtrate is forced through the filter cloths and out of the chamber; heating the filter cake in the chamber, wherein, during the heating, filtrate is forced through the filter cloths and out of the chamber; and releasing dried filter cake from said chamber. During the heating, the chamber may be vacuum pumped to facilitate removal of filtrate vapor. During vacuum processing a flare may be ignited on the exhaust of the vacuum pump to burn-off flammable vapors, if required. The heating may be by steam applied to envelopes in the filter plates. The process may further include applying pressure to the filter cake in the chamber during said heating, said applying pressure being by inflating the envelopes in the filter plates using steam or compressed gas. The slurry may include MFTs. The method may further comprise adding a flocculating/coagulating agent to the slurry and stirring to form a chemically processed solids-enriched slurry, before pumping the slurry into the filter press. Furthermore, the method may include adding additional solids to the slurry to form a solids-enriched slurry before pumping the slurry into the filter press, where the additional solids may include overburden from the mine, wherein the overburden may contain sand and/or dry "swelling" clay.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION

Figure 1:
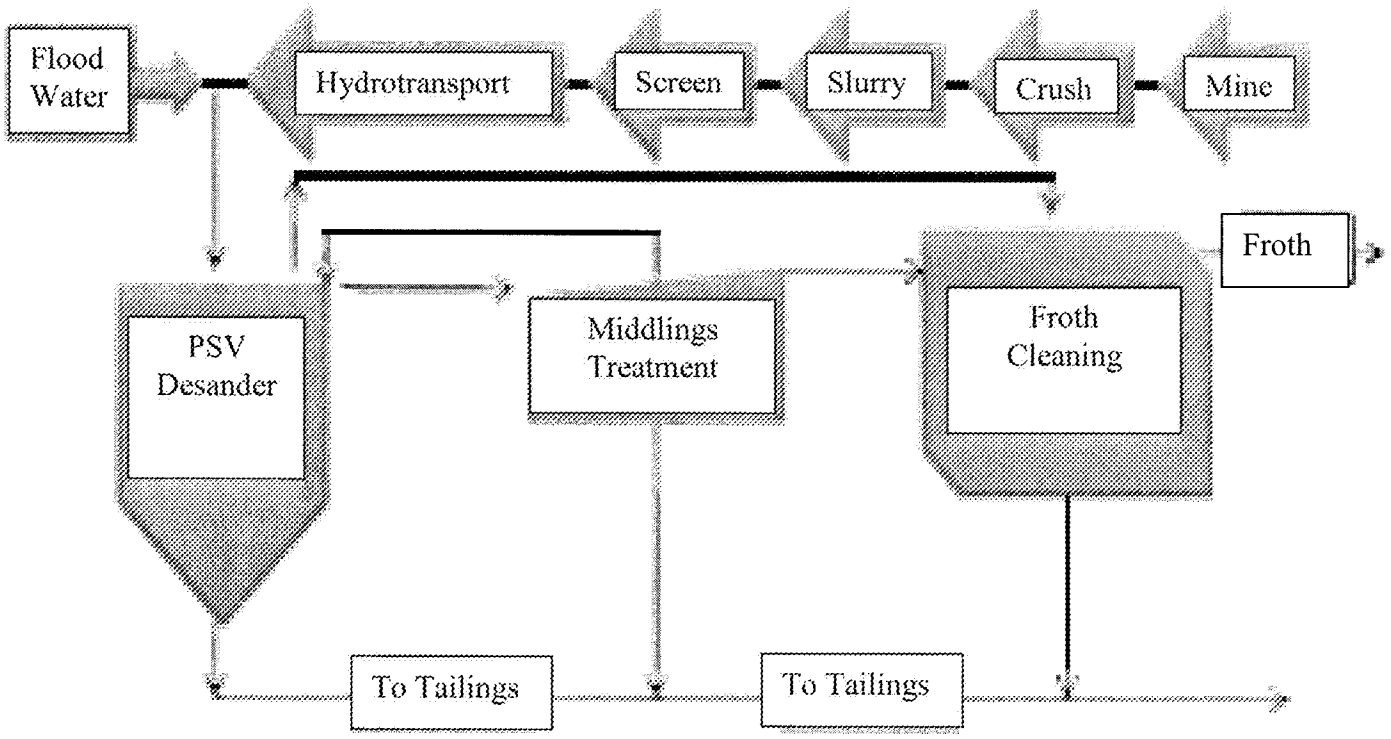
FIG. 1 PRIOR ART
FIG. 1 is a flow diagram illustrating a bitumen extraction process.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The present invention relates generally to extraction of bitumen and other oil products from sand, other sedimentary deposits and mine tailings. Furthermore, the present invention relates generally to the dewatering of the slurries used in bitumen extraction, including MFTs.

A process for extraction of bitumen and other oil products from sand, other sedimentary deposits and from mine tailings, may comprise flowing solvents through these bitumen-containing materials held in a filter press, where elevated pressures and temperatures may be used. The filter plates are made of cross-linked polyethylene or similar material which can withstand exposure to solvents under these conditions. After exposure to solvent(s) the sedimentary deposits may be exposed to water (hot liquid water or steam) and vacuum to remove residual solvents; a flare may be used on the exhaust from the vacuum pump to burn off volatile hydrocarbons which have not been condensed out. Suitable solvents include diluents such as natural gas condensate (which is a by-product of oil production from crude bitumen), pentanes, C5, other carbon-based solvents, etc., which are supplied to the filter press at a temperature below the evaporation point—typically around 40° C. for condensate. The solvent may be delivered to the chambers of the filter press through the feed ports, filtrate ports, etc.

Further embodiments of the bitumen extraction process may include substituting the solvent with: (1) boiling hot water (free boiling-100° C.); and (2) steam at a pressure of 15 psi (approximately 250° F.), for example. The materials that can be used for the filter plates may be less restricted when solvents are not used. The solvent-free method works for certain types of bitumen deposits—being effective in removing the bitumen and associated oil-based materials—and is advantageous in reducing emissions of solvent vapors from the filter press during the process. More specifically, the water-based extraction process works well when the predominant material from which the bitumen is being separated has a greater affinity for water than for oil—for example, sand particles comprised of quartz are not readily coated with bitumen and the bitumen can readily be separated from the sand using a hot water process.

The bitumen-containing materials may be provided to the filter press as a slurry, and the slurry may be pre-heated. (In embodiments in which some stages of bitumen extraction have already occurred, the slurry may be hot due to processing and may be provided to the filter press hot, thus making the processes in the filter press which include heating much more energy efficient. Furthermore, separating out hot water in the filter press and returning it to the process facility for reuse will significantly reduce the amount of heat lost from the bitumen process facility.) The slurry comprising bitumen-containing materials may be formed by crushing the sedimentary deposits and combining with water. In other embodiments, the slurry may comprise mine tailings—the slurry comprises sedimentary deposits that have already been pre-processed for removal of most of the bitumen and other oil-based materials. Slurry from various different stages of processing may be directed to a filter press for processing according to the present invention.

The present invention may include separation of liquids and insoluble solids, referred to as dewatering/drying. The separated liquid and solids are generally referred to as filtrate and filter cake, respectively. Some embodiments of this invention may include separation of mixtures of liquids and insoluble solids which include chemical treatment of the mixtures prior to processing in the filter press. The chemical treatment may include addition of flocculating/coagulating agent(s) to the mixture. Further embodiments of the present invention may include separation of the mixtures of liquids and insoluble solids which include addition of extra solids prior to processing in the filter press. For example, embodiments of the present invention may include extraction of bitumen and dewatering of MFTs including mixing additional solids such as overburden from the mine, wherein the overburden may contain sand and/or dry "swelling" clay, into the MFTs prior to bitumen extraction and dewatering.

Figure 2:
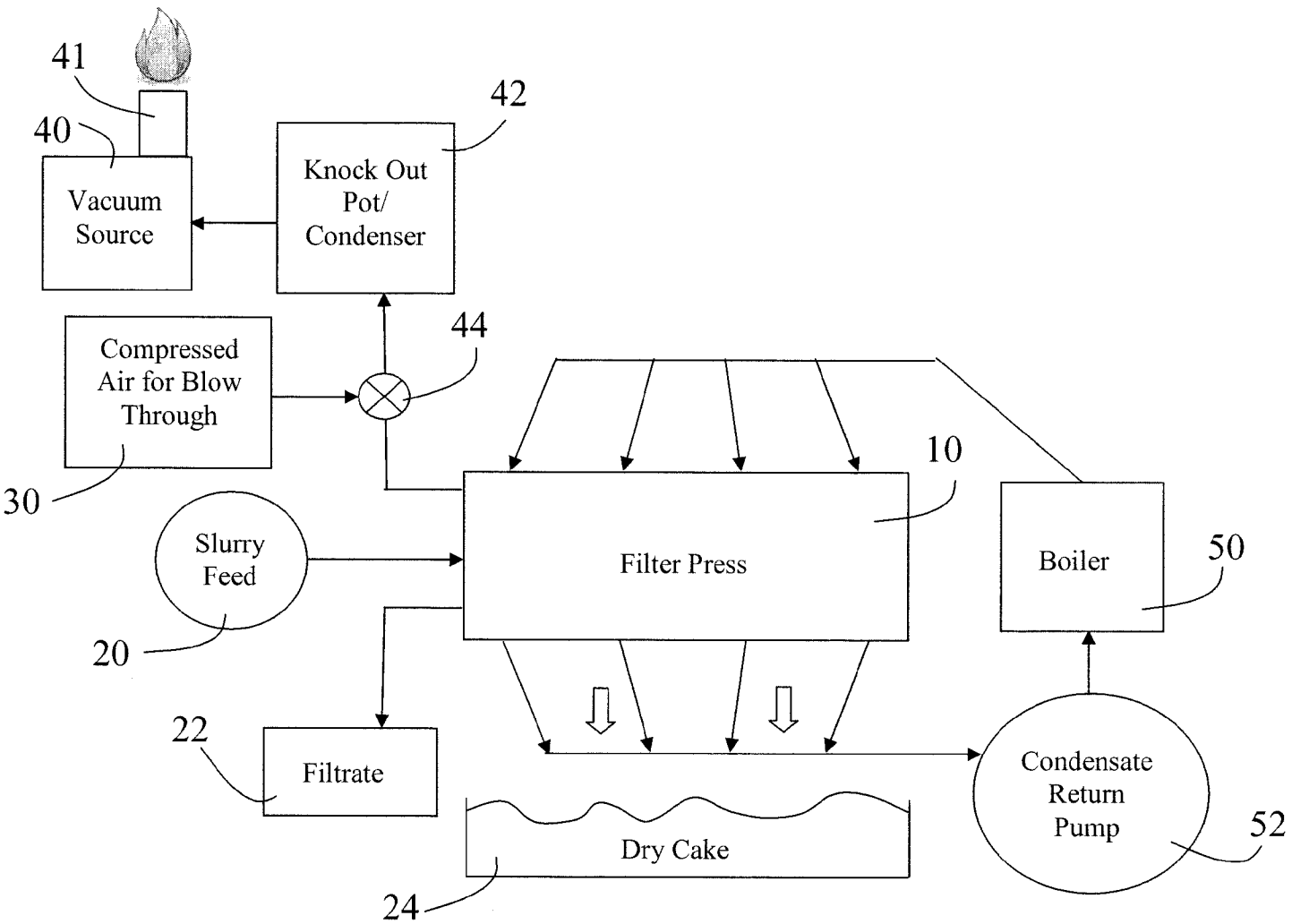
FIG. 2 is a schematic of a filter press system configured for bitumen extraction and dewatering, according to some embodiments of the present invention.

FIG. 2 shows a schematic of a filter press system which is representative of those manufactured and installed worldwide by I DES, Inc., DryVac Canada, Ltd. and affiliated companies; although, the present invention is not limited to these particular filter presses—many different filter presses may be used with some embodiments of the present invention or modified as described herein, as will be appreciated by those skilled in the art after reading the detailed description of the present invention. FIG. 2 shows a filter press 10 for processing a slurry provided to the filter press by slurry feed 20 to produce a filtrate 22 and a dry filter cake 24. The dry filter cake 24 is released from the filter press as indicated by the large arrows, as described in more detail below, and is collected in a tray, on a conveyor belt below the filter press, or in any other removal device. A slurry is fed into the filter press 10 for extraction and dewatering. The filter press system includes: an air compressor 30 for forcing air through the cake in the filter press to remove filtrate; a vacuum source 40 connected to a knock out pot/condenser 42 and then to the filter press 10 through a valve 44; a flare system 41 for burning-off flammable vapors at the exhaust of the vacuum source 40; and a boiler 50 for generating steam connected in a closed circuit to the filter press 10 and a condensate return pump 52—the direction of flow for the steam into the filter press and the condensate out of the filter press is indicated by the arrows. The vacuum source 40 is used to apply a vacuum to the filter cake in the filter press to remove filtrate (as either a liquid or a vapor). Note that the valve 44 is used to isolate either or both the air compressor 30 and/or the vacuum source 40 depending on what is required in a particular processing step in the filter press. The knock out pot part of 42 is basically a low velocity flow part of the vacuum line where filtrate may be collected; the condenser part of 42 condenses any filtrate present in vapor form. The boiler 50 produces steam, at approximately 15 psi, for heating the filter press 10 and/or inflating envelopes in the filter plates in the filter press, as described in more detail below. The filtrate 22 may be processed in a separation tank for separating the bitumen 71 and water 72.

Figure 3:
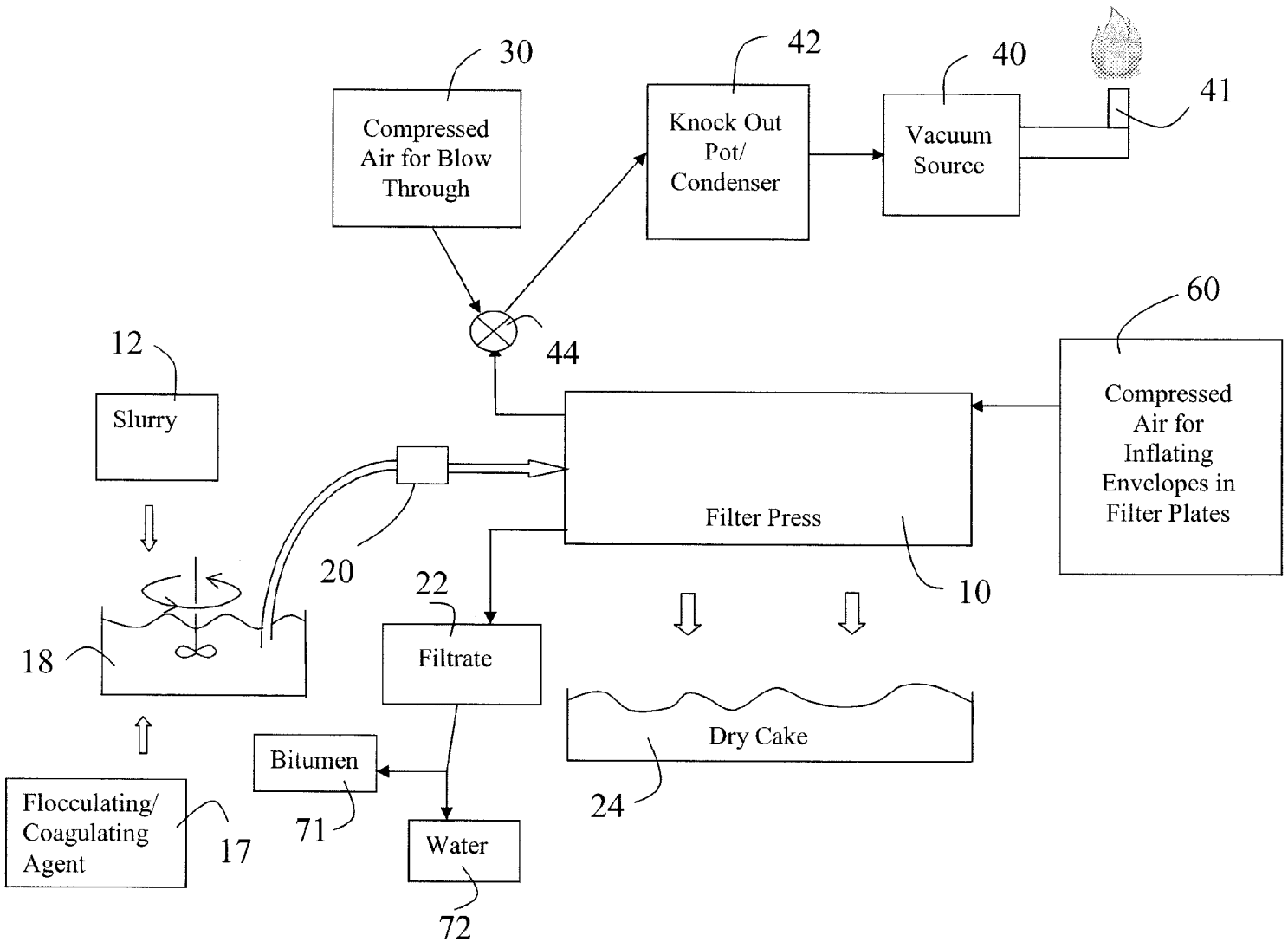
FIG. 3 is a schematic of a first embodiment of a filter press system configured for processing slurries, according to the present invention.

Slurries may be processed with a flocculating/coagulating prior to being pumped into the filter press, as shown in FIG. 3. Slurries containing MFTs may benefit from this pre-processing. The slurry is provided directly to a mixing tank 18, where a flocculating/coagulating agent 17 is added while agitating/stirring, the contents of the tank are agitated/stirred until a thick flock is formed, and then the agitation/stirring is stopped allowing the floc to settle to the bottom of the tank 18. The slurry may optionally be diluted prior to coagulation. If the slurry is diluted, the dilution is typically with water. The dilution process includes blending the slurry and water to provide a uniform solution. The purpose of the dilution is to facilitate mixing the slurry with the coagulating agent. Flocculation/coagulation is the process where colloids come out of suspension in the form of aggregates or floc—this differs from precipitation in that, prior to flocculation, colloids are merely suspended in a liquid and not actually dissolved in a solution. Flocculants/coagulants may be used in slurry treatment to improve sedimentation and thus the effectiveness of processing the slurry in the filter press. The coagulants work by neutralizing surface charges on the small particles in the slurry which cause the small particles to repel each other. Once the charges are neutralized the particles will agglomerate when they collide due to Van de Waals forces. Many flocculants/coagulants are multivalent cations such as aluminum, iron, calcium or magnesium, for example, alum. In place of, or in addition to, mineral flocculants, synthetic flocculants may be used. Some examples of synthetic flocculants include polymers such as anionic and cationic polyacrylamides.

An example of chemical processing of slurries with a flocculating/coagulating agent is as follows. The slurry in the mixing tank is mixed with agitators. A 350 ml sample of the slurry is used to determine the amount of alum required for the slurry in the mixing tank. The sample is stirred and alum is added in 1 ml increments until the pH reaches somewhere in the range of 6.2-6.9; this dose of alum is then used to calculate the amount of alum needed for the volume of slurry in the mixing tank. Next, an anionic water soluble polymer, such as the drilling fluid additive Alkapam A-1703 (available from Diversity Technologies Corp, Edmonton, Alberta, Canada), is added in 1 ml increments to the sample of alum-treated slurry while stirring until floc forms and free water is observed. The stirring is continued and if the floc breaks down more anionic water soluble polymer is added until a tight floc is formed and the water looks clear. This dose of anionic water soluble polymer is then used to calculate the amount of alum needed for the volume of slurry in the mixing tank. The calculated amount of alum is added to the slurry in the mixing tank while agitating the slurry, followed by adding the calculated amount of anionic water soluble polymer to the slurry mixture in the mixing tank while agitating the slurry. Note that in some circumstances—described in more detail below—a cationic polyacrylamide, such as the drilling fluid additive Alkapam C-1803 (available from Diversity Technologies Corp, Edmonton, Alberta, Canada), is added to the slurry after the anionic water soluble polymer. The dose of cationic polyacrylamide is determined by adding 1 ml amounts to the slurry sample already treated with alum and anionic water soluble polymer until a stable floc forms. This dose of cationic polyacrylamide is then used to calculate the amount of cationic polyacrylamide needed for the volume of slurry in the mixing tank. The calculated amount of cationic acrylamide is added to the slurry in the mixing tank after the alum and anionic water soluble polymer, while agitating the slurry mixture. Note that the flocculants are added serially.

The circumstances in which the use of a cationic polyacrylamide is considered are described as follows. When the slurry sample is treated with alum and an anionic water soluble polymer, as described above, and does not exhibit good flocculation and separation of solids and water within a short time, for example two minutes, then a dewatering test is carried out. The dewatering test assesses the dewatering characteristics of the mixture, and if found unacceptable, a cationic polyacrylamide may be added to further improve the dewatering characteristics.

After flocculation/coagulation, the contents of the mixing tank 18 are pumped into the filter press 10 using a pump 20. The pump 20 may be a low shear pump, such as a hydraulic concrete pump or similar pump. Alternatively, after flocculation/coagulation, the floc may be allowed to settle in the tank 18, leaving clear liquid at the top of the tank; this clear liquid may be siphoned off before pumping the floc into the filter press 10 using a low shear pump. The siphoned liquid may separately be chemically treated and/or filtered. The chemically processed slurry mixture goes through bitumen extraction and is dried in the filter press 10 as described below with reference to FIGS. 5A-5D. Furthermore, after drying the chemically processed mixture in the filter press, more of the chemically processed mixture may be pumped into the filter press, without emptying the chambers, and go through bitumen extraction and drying in the filter press; this process flow may be used when the total solids load in the chemically processed mixture is low and the solids capacity of the chambers in the filter press have not yet been reached.

FIG. 3 also shows an embodiment of the filter press system of the present invention in which compressed air is used for inflating the envelopes in the filter plates. However, steam or another means of heating the contents of the filter chambers may also be used. Furthermore, the envelopes may be used for cooling the contents of the filter chambers, if required, by pumping a coolant through the envelopes.

Figure 4:
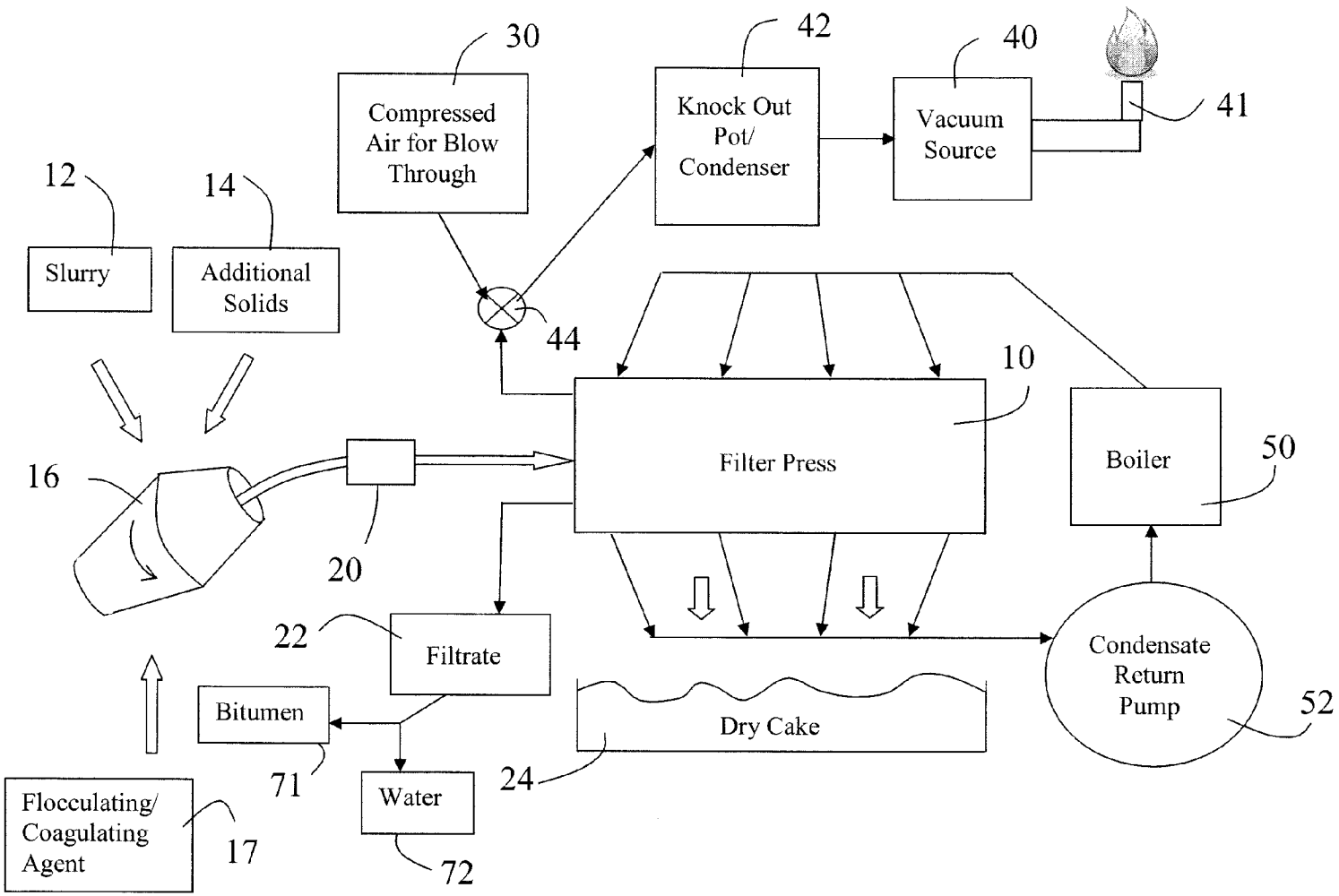
FIG. 4 is a schematic of a second embodiment of a filter press system configured for processing slurries, according to the present invention.

Slurries may be combined with additional solids for processing in the filter press system, as shown in FIG. 4. The additional solids may be overburden from the mine, wherein the overburden may contain sand and/or dry "swelling" clay. The additional solids may also be materials such as paper pulp. The slurry may include MFTs. The slurry 12 and additional solids 14 are combined in a mixing vessel 16, such as a commercially-available cement/concrete mixer or other relatively low shear mixing vessel. (The mixing vessel may be an elongated drum rotatable about its longitudinal axis, the longitudinal axis being at roughly 45 degrees to the horizontal.) The slurry and additional solids are mixed in the mixing vessel until a homogeneous slurry is formed; the solids-enriched slurry has a significantly higher solids load than the slurry alone. A typical mixture consists of up to 50% additional solids. Next, if desired, the solids-enriched slurry may be chemically processed with a flocculating/coagulating agent, as described above. Here, the chemical processing may conveniently occur in the mixing vessel. The mixture is then processed through the filter press to extract bitumen and dewater the slurry as described below with reference to FIGS. 5A-5D.

As is well known in the art, filter presses include a stack of filter plates, the filter plates are covered by filter cloths, and each pair of filter plates defines a chamber lined with filter cloths into which slurry or other material is fed for dewatering or similar processing. Generally, there will be a stack of N filter plates in a filter press, and M chambers between the plates, where M=N−1 and M and N are integers. Details of filter plates which are representative of those manufactured and installed worldwide by I DES, Inc., DryVac Canada, Ltd. and affiliated companies are provided below and in FIGS. 9-11. Filter plates are also described in U.S. Pat. Nos. 5,672,272 and 6,149,806 to William Baer and PCT International Publication Number WO 97/00171 to Dan Simpson et al., incorporated by reference in their entirety herein.

The schematic illustrations of FIGS. 5A-5D is used to describe a method of bitumen extraction and dewatering of slurries including bitumen-containing sedimentary materials using a filter press system, such as the filter press systems shown in FIGS. 2-4, according to some embodiments of the present invention. The illustrations in FIGS. 5A-5D show a cross-sectional view of a block of three adjacent filter plates in the filter press for four different process steps. Each of the filter plates is shown to comprise a frame 110 around the periphery of the plate, a diaphragm 120 in the center of the plate, the diaphragm containing a hollow envelope 130 which can be inflated or deflated in order to squeeze the filter cake 24 which sits in chambers between the filter plates. Filtrate 22 is removed from the filter press through ducts as shown.

Figure 5A:
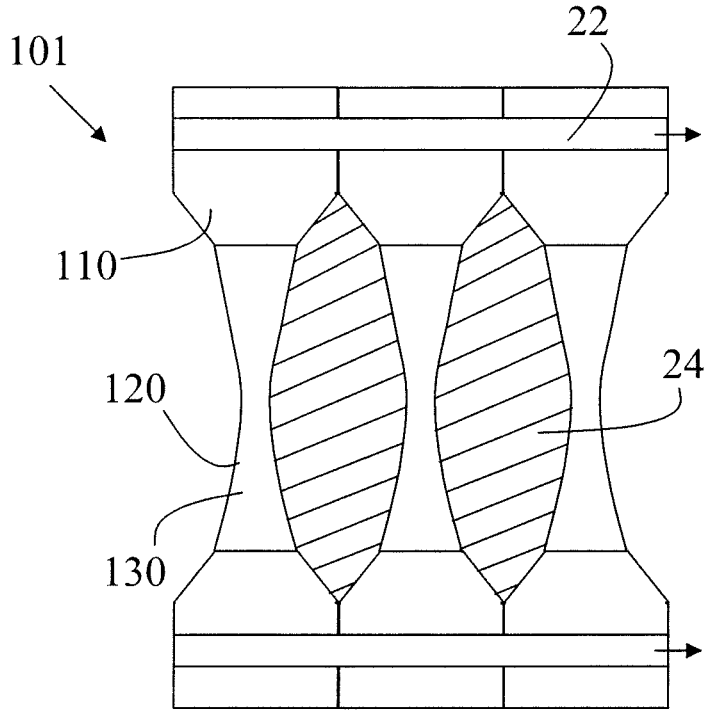
FIGS. 5A-5D are a representation of a process for bitumen extraction from, and dewatering of, tailings using a filter press, according to some embodiments of the present invention.

A slurry is fed into the chambers of a filter press, forming a filter cake 24 in the chambers. As the slurry is forced into the chambers, some of the filtrate 22 is lost through filter cloth which lines the chambers and leaves the filter press through ducts in the filter plates. This is shown in FIG. 5A—note that the envelopes 130 are not inflated at this point in the process.

Figure 5B:
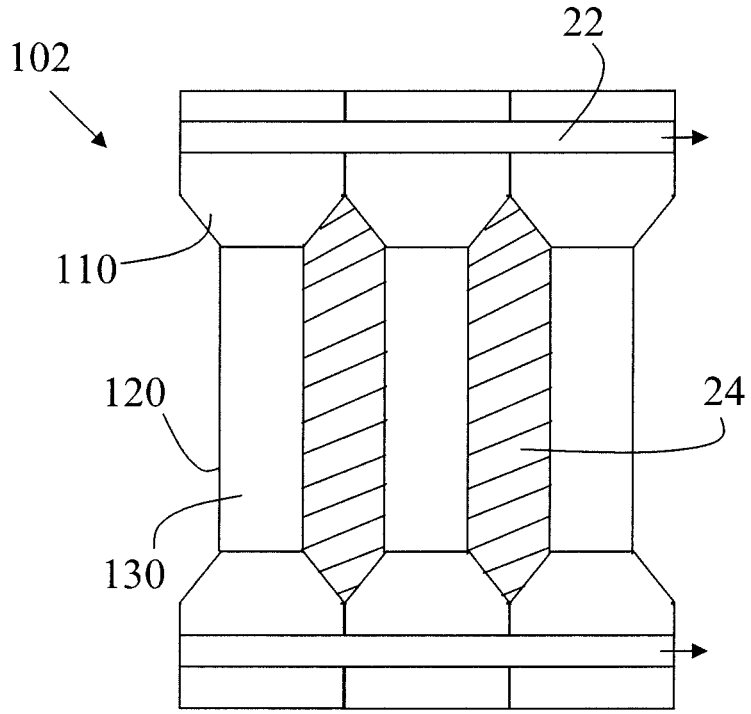
Figure 5C:
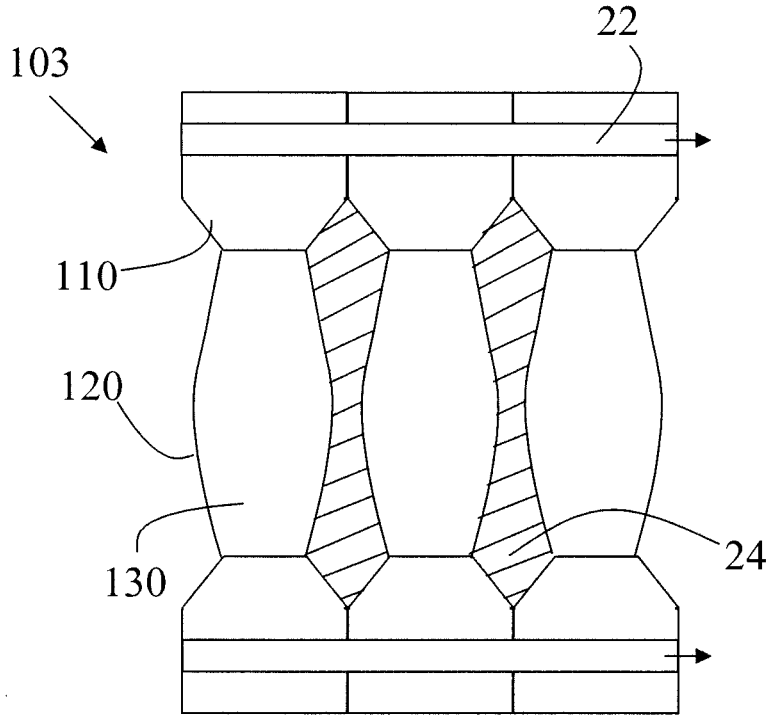
Figure 5D:
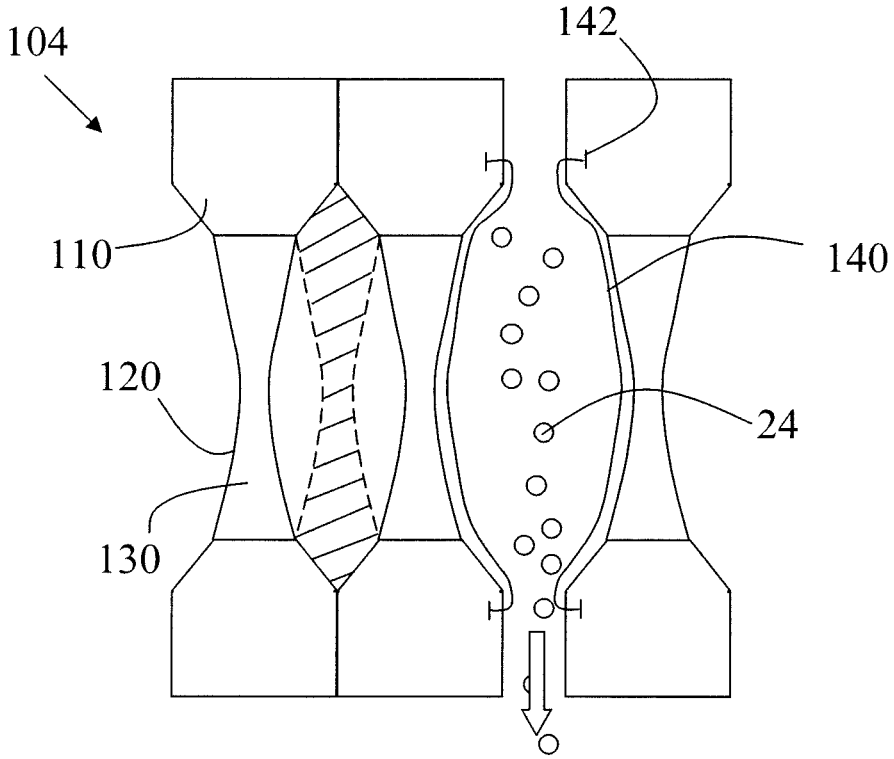

The solvent or hot water/steam may follow the slurry into the chambers through the feed ports, flowing through the filter cake, extracting some of the bitumen and leaving through ducts in the filter plates. As an alternative, or in addition, it may be advantageous to have the solvent or hot water/steam flow into the chambers through the filtrate ports and then be extracted again through the filtrate ports—this can be achieved with valves in the filtrate lines. Furthermore, the same solvent or hot water/steam may be passed through the filter cake multiple times to increase the concentration of bitumen. The filter cake 24 is squeezed by inflating the envelopes 130 in the filter plates, while blowing compressed air through the filter cake. Both the squeezing and blowing act to remove filtrate from the filter cake and act together efficiently, although the squeezing and blowing may be used separately or just one of the squeezing or blowing may be used. FIG. 5B shows the envelopes 130 partially inflated, by steam, for squeezing the filter cake 24 in the chambers. The filter cake 24 is heated in the chambers by steam in the envelopes 130, while pulling a vacuum on the filter cake. As an alternative to, or in addition to the aforementioned flowing of solvent or hot water/steam, the solvent or hot water/steam may be flowed through the filter cake when vacuum is applied. FIG. 5C shows the envelopes 130 fully inflated by steam, which also acts to heat the filter cake. The combination of pulling a vacuum on the filter cake 24 in the chambers and the inflation of the envelopes 130 by compressed air squeezes more filtrate 22 out of the filter cake 24 and reduces the volume of the chambers. Note that the filtrate 22 may be removed from the filter cake 24 as a vapor or a liquid, depending on the physical properties of the filtrate and the environmental conditions in the chamber—specifically temperature and pressure. The filter press is opened and the dried filter cake 24 is released. At this point in the process the vacuum is no longer applied to the filter cake and the envelopes 130 have been deflated. As shown in FIG. 5D, the filter plates are separated to allow the dried filter cake 24 to fall out of the chambers and to be collected. Each of the chambers is lined with filter cloths 140, which are kept in position by retaining strips 142. See the right hand chamber in FIG. 5D for an illustration of the filter cloths; for ease of illustration of other features, the filter clothes have not been shown in the other chambers of FIGS. 5A-5D.

Other embodiments of the bitumen extraction process may have the solvent or hot water/steam combined with the slurry prior to or during pumping into the filter press, as an alternative to having the solvent or hot water/steam following the slurry. In addition, it may be advantageous to have the solvent or hot water/steam flow into the chambers through the filtrate ports and then be extracted again through the filtrate ports—this can be achieved with valves in the filtrate lines.

Figure 6:
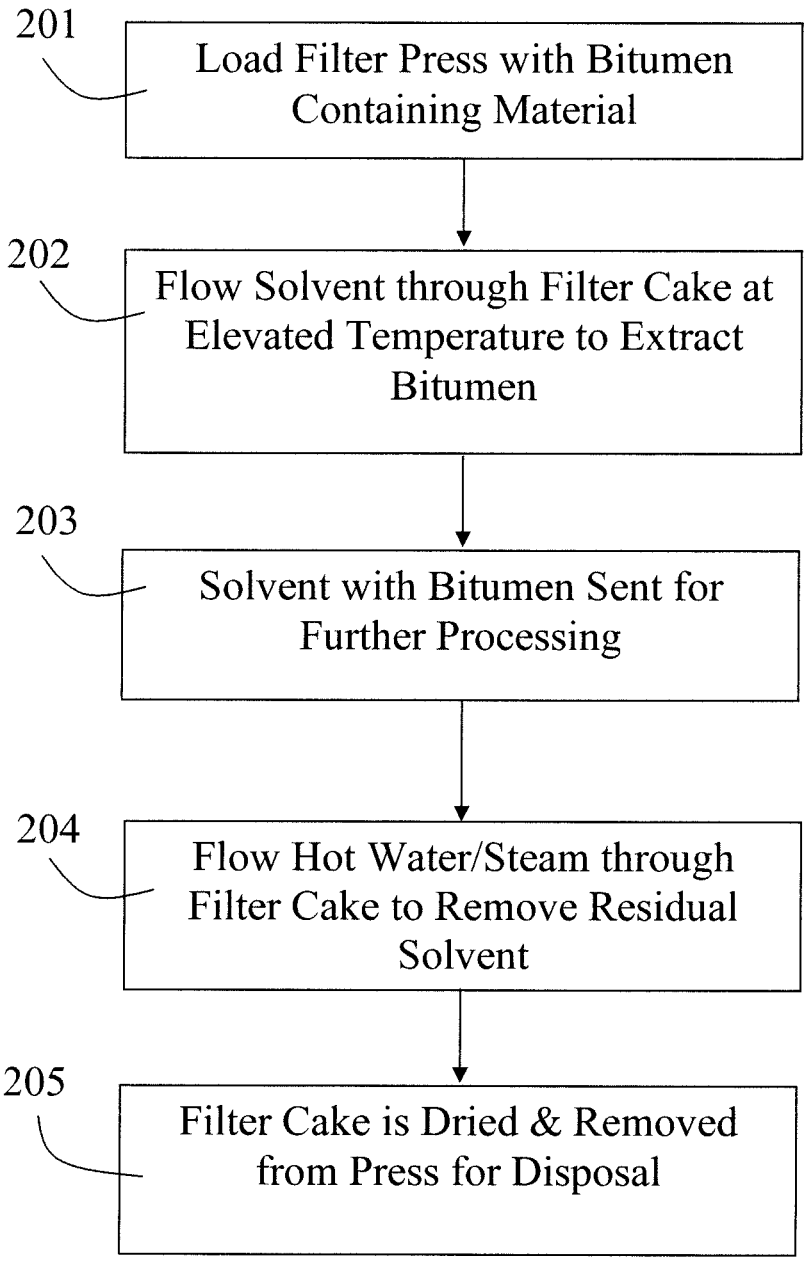
FIG. 6 is a process flow for bitumen extraction from tailings using solvents and a filter press, according to some embodiments of the present invention.

FIG. 6 is an example of a process flow according to the present invention for bitumen extraction from, and dewatering of, slurries including bitumen-containing sedimentary materials using solvents. The filter press is loaded with a slurry including bitumen-containing sedimentary material (201); solvent is flowed through the filter cake at elevated temperature for extracting bitumen (202); the solvent with bitumen is sent away for further processing (203); hot water/steam is flowed through the filter cake to remove residual solvent (204); filter cake is dried and removed from the press for disposal (205). As described above, with reference to FIGS. 5A-5D, alternative process flows may have the solvent mixed with the slurry immediately before, or as, it is pumped into the filter press. Furthermore, solvent may be added at different times during processing of the same filter cake—for example, during pumping into the filter press and/or during application of vacuum.

According to aspects of the invention, a method of extracting bitumen from a bitumen-containing sedimentary material using organic solvents may comprise: providing a slurry of bitumen-containing sedimentary material; pumping the slurry into a chamber between two filter plates in a filter press to form a filter cake, wherein the chamber is lined by filter cloths, and wherein, during the pumping, filtrate is forced through the filter cloths and out of the chamber; and pumping solvents through the filter cake to dissolve the bitumen and carry it away in the effluent. The process may further include heating the filter cake in the chamber, during said pumping solvents. During the heating and pumping solvents, the chamber may be exposed to a vacuum. During vacuum processing a flare may be ignited on the exhaust of the vacuum pump to burn-off flammable vapors. After exposure to solvents the filter cake may be exposed to water and vacuum for removal of residual solvents prior to release of the filter cake from the filter press, wherein the water may be hot liquid water or steam. The slurry may comprise mine tailings. The process may further include applying pressure and/or heat to the filter cake in the chamber during said pumping solvents, said applying pressure and/or heat being by inflating envelopes in said filter plates using steam or compressed gas. Alternative process flows may have the solvent mixed with the slurry immediately before, or as, it is pumped into the filter press. Furthermore, solvent may be added at different times during processing of the same filter cake—for example, during pumping into the filter press and/or during application of vacuum.

Figure 7:
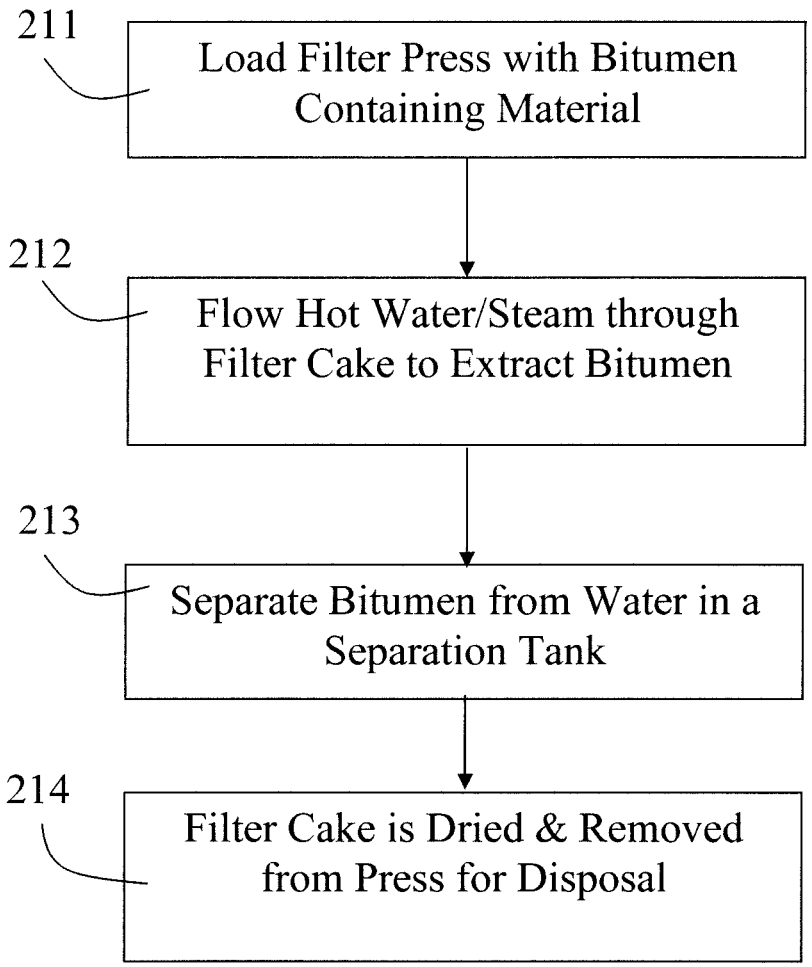
FIG. 7 is a process flow for bitumen extraction from tailings using hot water/steam and a filter press, according to some embodiments of the present invention.

FIG. 7 is an example of a process flow according to the present invention for bitumen extraction from, and dewatering of, slurries including bitumen-containing sedimentary materials using water/steam. The filter press is loaded with a slurry including bitumen-containing sedimentary material (211); hot water/steam is flowed through the filter cake at elevated temperature for extracting bitumen (212); the bitumen is separated from the water in a separation tank (213); filter cake is dried and removed from the press for disposal (214). As described above, with reference to FIGS. 5A-5D, alternative process flows may have the hot water/steam mixed with the slurry immediately before, or as, it is pumped into the filter press. Furthermore, hot water/steam may be added at different times during processing of the same filter cake—for example, during pumping into the filter press and during application of vacuum.

According to aspects of the invention, a method of extracting bitumen from a bitumen-containing sedimentary material using water may comprise: providing a slurry of bitumen-containing sedimentary material; pumping the slurry into a chamber between two filter plates in a filter press to form a filter cake, wherein the chamber is lined by filter cloths, and wherein, during the pumping, filtrate is forced through the filter cloths and out of the chamber; and pumping water through the filter cake to dissolve the bitumen and carry it away in the effluent. Wherein the water may be hot liquid water, freely boiling water, or steam, at a pressure of roughly 15 psi or greater. Furthermore, the oil-based substances released from the tailings may be separated from water in the effluent—a separation tank may be used for this process. The process may further include applying pressure and/or heat to the filter cake in the chamber during said pumping water, said applying pressure and/or heat being by inflating envelopes in said filter plates using steam or compressed gas. The slurry may comprise mine tailings. Alternative process flows may have the hot water/steam mixed with the slurry immediately before, or as, it is pumped into the filter press. Furthermore, hot water/steam may be added at different times during processing of the same filter cake—for example, during pumping into the filter press and/or during application of vacuum.

According to aspects of the invention, a method of extracting bitumen from mine tailings in a filter press may comprise: providing a water-based slurry including tailings; pumping the slurry into a chamber between two filter plates in the filter press to form a filter cake, wherein the chamber is lined by filter cloths, and wherein, during the pumping, filtrate is forced through the filter cloths and out of the chamber; separating residual bitumen from water in an oil/water separator; heating the filter cake in the chamber, wherein, during the heating, filtrate is forced through the filter cloths and out of the chamber; and releasing dried filter cake from said chamber. During the heating, the chamber may be vacuum pumped to facilitate removal of filtrate vapor. During vacuum processing a flare may be ignited on the exhaust of the vacuum pump to burn-off flammable vapors. The heating may be by steam applied to envelopes in the filter plates. The process may further include applying pressure to the filter cake in the chamber during said heating, said applying pressure being by inflating the envelopes in the filter plates using steam or compressed gas. The slurry may include MFTs. The method may further comprise adding a flocculating/coagulating agent and stirring to form a chemically processed solids-enriched slurry, before pumping the slurry into the filter press. The method may further comprise pumping water/solvent through the filter cake to dissolve the bitumen and carry it away in the effluent. Furthermore, the oil-based substances released from the tailings may be separated from water in the filtrate—a separation tank may be used for this process. Yet furthermore, this process may also be applied to a slurry of the crushed mined deposit, rather than just to the tailings.

According to aspects of the invention, a method of extracting bitumen from solids-enriched mine tailings in a filter press may comprise: providing a water-based slurry including the tailings; adding additional solids to the slurry to form a solids-enriched mixture; pumping the solids-enriched mixture into a chamber between two filter plates in the filter press to form a filter cake, wherein the chamber is lined by filter cloths, and wherein, during the pumping, filtrate is forced through the filter cloths and out of the chamber; heating the filter cake in the chamber, wherein, during the heating, filtrate is forced through the filter cloths and out of the chamber; and releasing dried filter cake from said chamber. The heating may be by steam applied to envelopes in the filter plates. During the heating, the chamber may be vacuum pumped to facilitate removal of filtrate vapor. During vacuum processing a flare may be ignited on the exhaust of the vacuum pump to burn-off flammable vapors. The mixture may include MFTs and the additional solids may be overburden from the mine, wherein the overburden may contain sand and/or dry "swelling" clay. Furthermore, additional solids may comprise paper pulp. The method may further comprise diluting the solids-enriched mixture, adding a flocculating agent and stirring to form a chemically processed solids-enriched mixture, before pumping the mixture into the filter press. The process may further include applying pressure to the filter cake in the chamber during said pumping, said applying pressure being by inflating envelopes in said filter plates using steam or compressed gas.

Figure 8A:
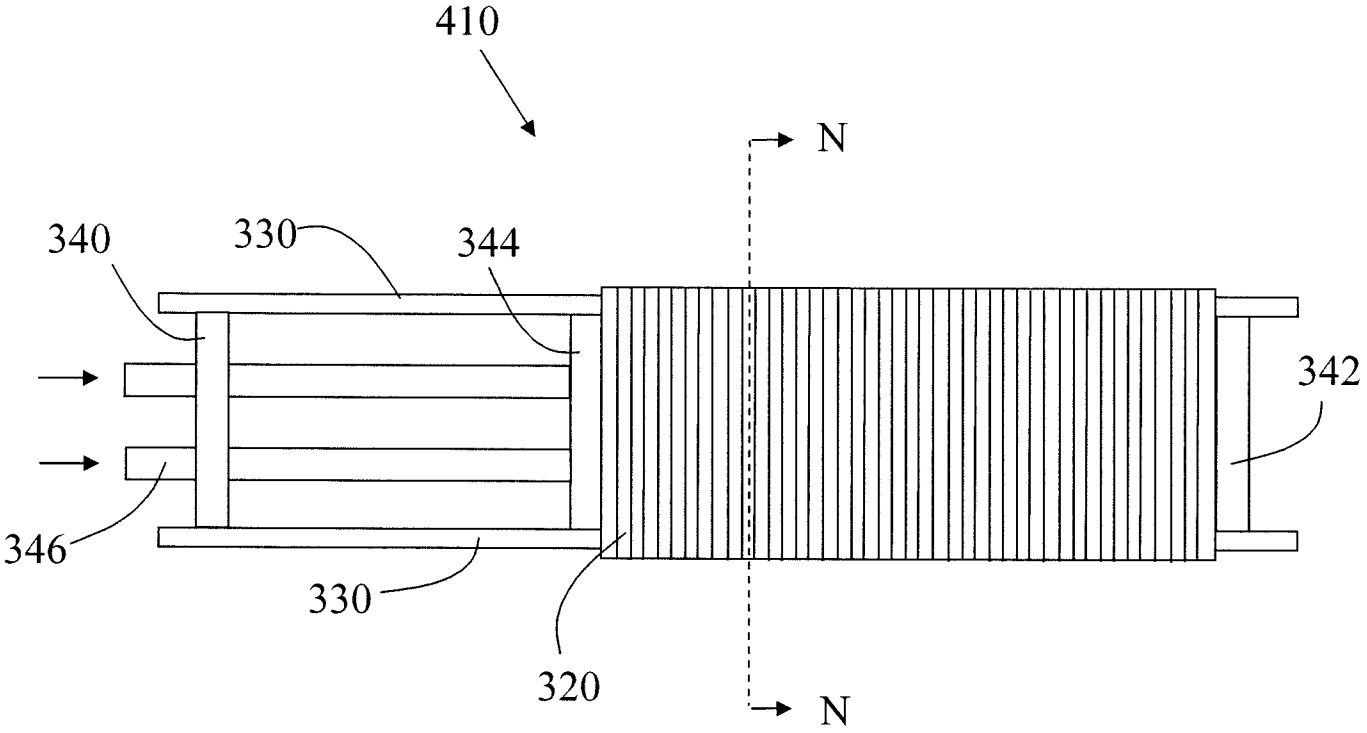
FIG. 8A shows a top view of a filter press, according to some embodiments of the present invention.

FIG. 8A shows a top view of a filter press 410, according to some embodiments of the present invention. The filter press 410 includes a stack of filter plates 320 mounted in a press comprising frame rails 330, on which the filter plates hang, fixed end plates 340 and 342, a movable plate 344, and rods 346 for applying a compressive force to the movable plate 344 as shown. Application of a compressive force to the movable plate 344 results in compressing the stack of filter plates 320.

Figure 8B:
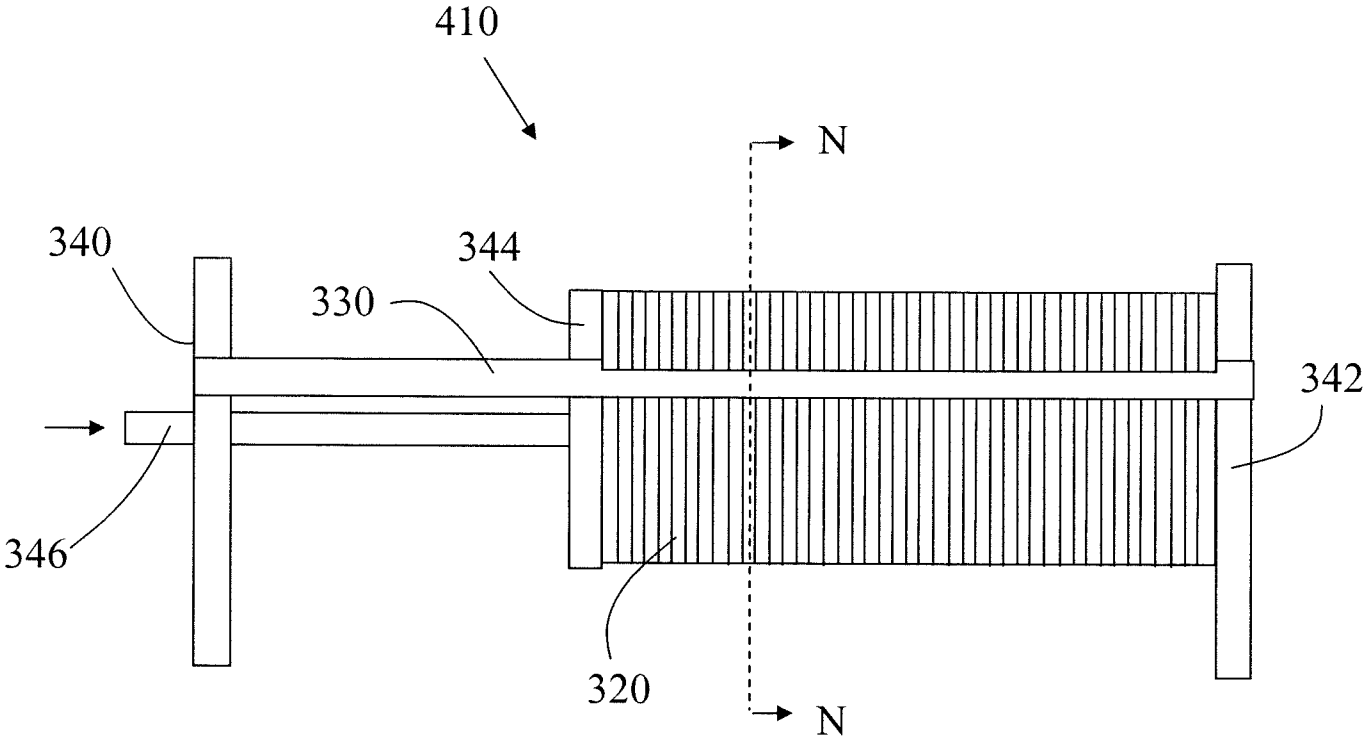
FIG. 8B shows a side view of the filter press of FIG. 8A.

FIGS. 8A & 8B show top and side views of a filter press 410, according to some embodiments of the present invention. The filter press 410 includes a stack of filter plates 320.

Figure 9:
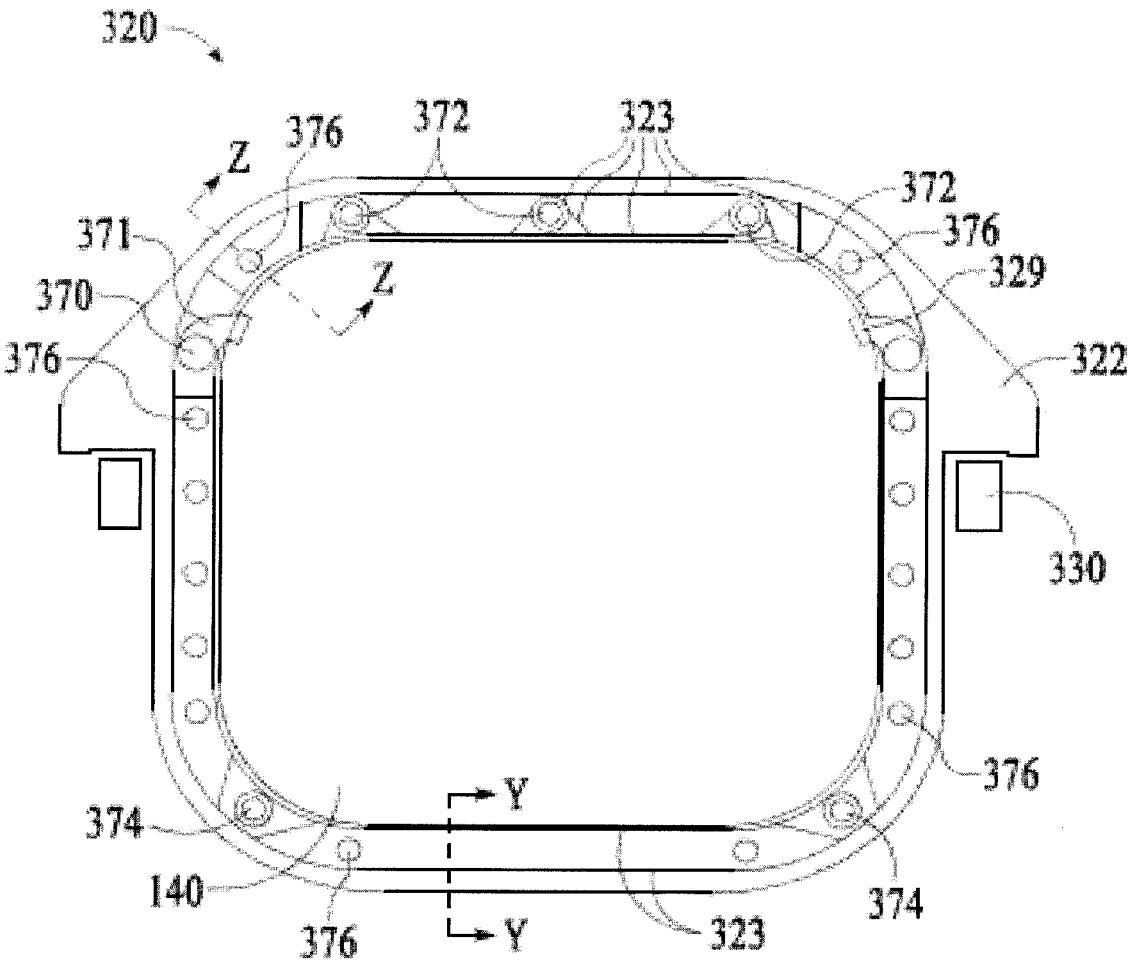
FIG. 9 is a cross section of the filter press shown in FIGS. 8A & 8B showing details of a filter plate, according to some embodiments of the present invention.

FIG. 9 is a section along N-N in FIGS. 8A & 8B. The frame rails 330 are shown in cross-section; however, for purposes of clear illustration of certain features, the filter plate 320 is shown in plan view. The configuration of the frame rails 330 relative to the filter plate 320 is clearly shown. FIG. 9 also shows the handles 322 which are used to place the filter plate 320 on frame rails 330 and may also be used to move the plates along the frame rails. Filter cloth 140 is shown attached to the filter plate 320.

FIG. 9 also shows the various ports which are situated around the periphery of the filter plate 320. These ports are apertures which extend completely through the filter plate and connect with the corresponding ports on the neighboring filter plates in the stack. The slurry is delivered through feed ports 370. The example shown in FIG. 9 is referred to as a side feed port. The configuration of the feed ports may be changed to provide top delivery, if desired. Delivery slots 371 are machined into the filter plate to allow the mixture to get from the feed port into the filter cloth lined chamber formed between adjacent filter plates. Steam ports 372 are for delivering steam into the envelope in the middle of the filter plate, and condensate ports 374 are for draining condensate from the envelope. (The envelope 130/360 is shown in FIGS. 5A-5D.) Alternatively, ports 372 and 374 may be used for inflating/deflating the envelope using compressed air—when steam is not being used. Ports 376, which include the unlabelled ports along the vertical sides of the filter plate 320, are used to connect to either compressed air during the blowing of air through the filter cake, or to vacuum when the filter cake is being heated. Furthermore, feed ports 370 may be used for delivering solvent or hot water/steam for the bitumen extraction.

Figure 10:
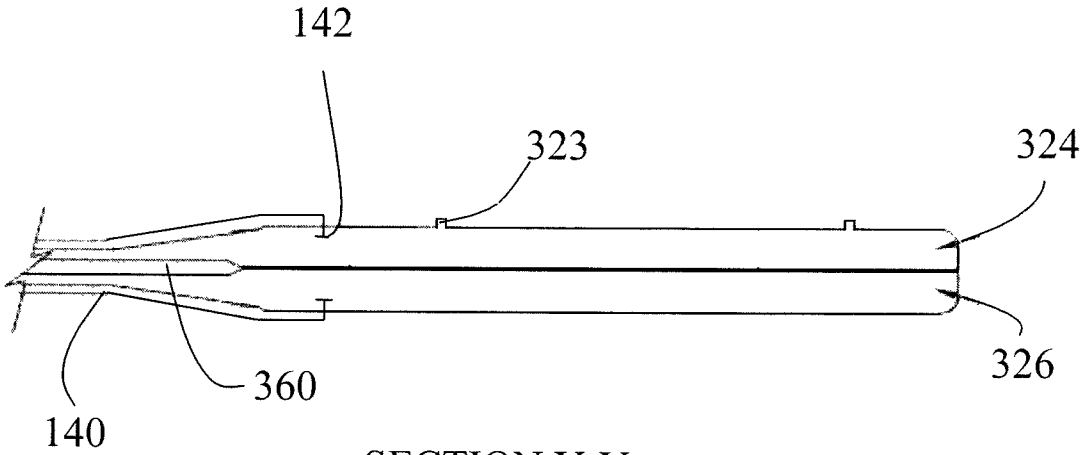
FIG. 10 is a cross-section of the filter plate of FIG. 9 showing detail of the sealing flanges, according to some embodiments of the present invention.
Figure 11:
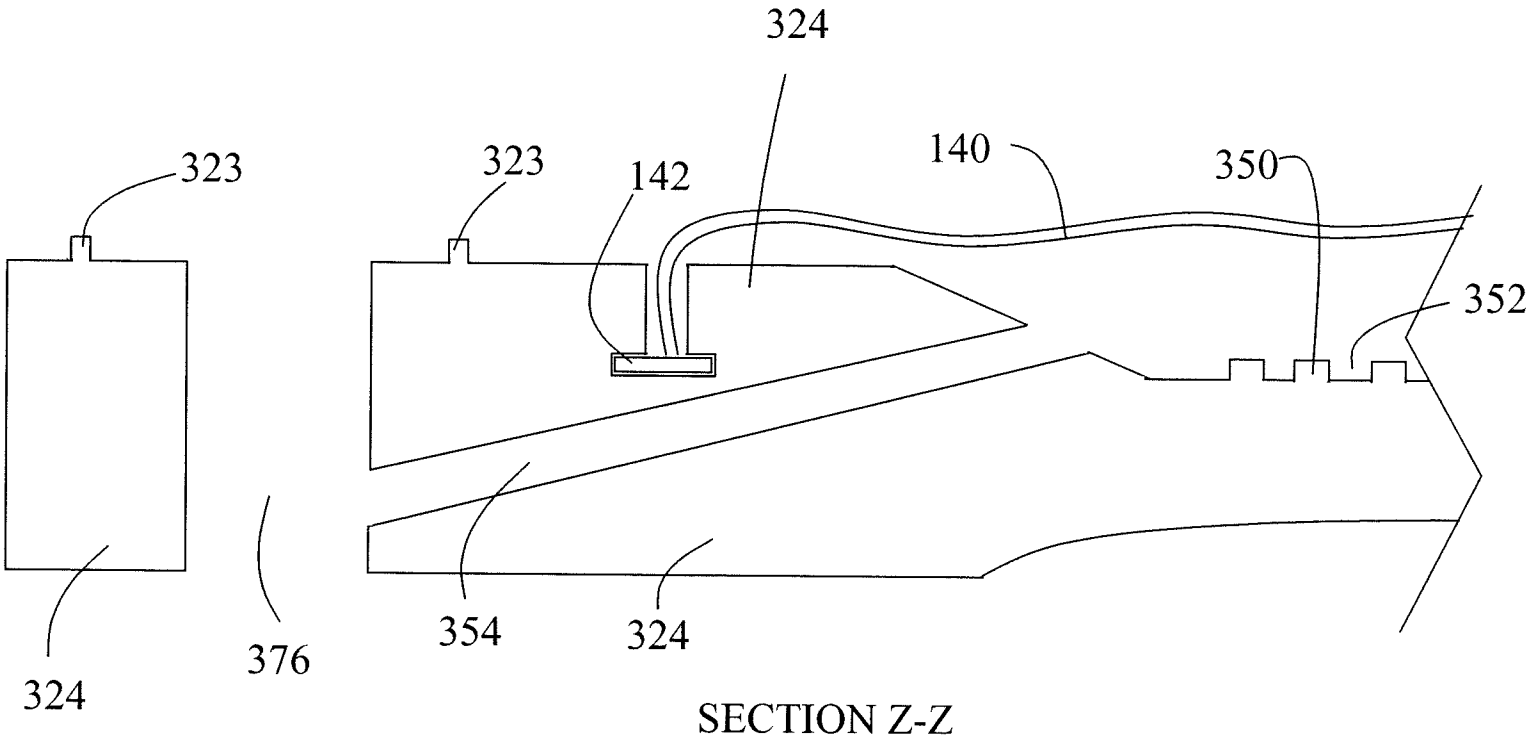
FIG. 11 is a cross section of the filter plate of FIG. 9, showing drainage holes and the retention of the filter cloth, according to some embodiments of the present invention.

FIGS. 9-11 show compression rings/flanges 323 that may be used to form a seal between adjacent filter plates. FIG. 10 is a cross-section along Y-Y in FIG. 9. Each of the filter plates has a flange on a first side (upper part 324) and a flat surface on the second side (lower part 326). The flange has a rectangular cross-section, as shown. When the flange of a first plate is brought into contact with the flat surface of an adjacent second plate and pressure is applied, a seal is formed between the first and second plates. The flanges 323 are also seen to provide isolation for the different ports around the periphery of the filter plate, thus ensuring that vacuum ports are isolated from feed ports, for example.

FIG. 9 also shows the position of the filter cloth 140 in the central area of the filter plate 320. Note that a clamp 329 is used to fix the edge of the filter cloth at the bottom of delivery slot 371, which ensures that the mixture is directed into the filter cloth lined chamber formed between adjacent filter plates. Furthermore, FIG. 10 shows filter cloths 140 on both sides of the filter plate (the filter plate comprising upper part 324 and lower part 326). The filter cloths are held in place by retaining straps 142, which are discussed in more detail below with reference to FIG. 11. When using solvents for bitumen extraction the filter cloth material must be resistant to the solvent (at temperature and pressure)—suitable materials include polypropylene, polyester, Teflon®, nylon, rayon, etc. and even stainless steel, depending on the chemistry being used.

FIG. 11 shows a cross-sectional representation of the upper part 324 of filter plate 320 along Z-Z in FIG. 9. The section is through a compressed air/vacuum port 376 and shows how the port 376 communicates with the chamber in between filter plates through machined hole 354. Hole 354 may have a circular cross-section in a plane orthogonal to the plane of the section. Hole 354 allows air to be forced through the filter cake or allows filtrate vapor to be vacuumed out of the chamber. Although not shown, those skilled in the art will appreciate, after reading the present disclosure, that a similar configuration may exist at the ports 372 and 374 for allowing steam or compressed air to inflate the envelope 360.

The filter cake is positioned in a chamber in between filter plates, where the chamber is lined with filter cloths 140. The section in FIG. 11 shows the filter cloth 140 at the edge of the chamber and shows how the cloth may be kept in position using a vinyl strap 142 seated in a "T" shaped slot machined in the filter plate. The vinyl strap 142 may be stitched into the edge of the filter cloth 140. The section also shows on the surface of the diaphragm part of the filter plate features 350 with channels 352 between the features. The channels are arranged so as to allow any filtrate vapor which is squeezed or vacuumed through the filter cloth 140 to pass to hole 354 and to vacuum port 376. The filter plate is similarly configured at each vacuum port 376. (See FIG. 9 for position of ports.)

According to aspects of the invention, a filter press system for extracting bitumen from a slurry including bitumen-containing sedimentary deposits may comprise: a frame; a plurality of filter plates configured to form a stack of parallel plates, each of the plurality of filter plates being movably attached to the frame, the plurality of filter plates further being configured to form a multiplicity of chambers, each of the multiplicity of chambers being formed by adjacent filter plates of the plurality of filter plates, each of the multiplicity of chambers being lined by filter cloths, wherein the plurality of filter plates, the multiplicity of chambers and the filter cloths are configured to allow filtrate to escape from the chambers while retaining solids from the slurry to form a filter cake; and a heater for heating filter cake in the multiplicity of chambers; wherein said filter plates are formed of polymers that can withstand prolonged exposure to hot solvents, such as natural gas condensate at a temperature of 45° C. (Note that higher temperatures may be tolerated when vacuum is applied.) Furthermore, a vacuum pump may be connected to the multiplicity of chambers to assist in removal of excess solvents from the filter cake in the chambers. A flare system may be attached to the exhaust of the vacuum pump for burning-off flammable vapors, particularly flammable vapors generated during vacuum processing. Yet furthermore, the filter plates may be configured with envelopes for applying pressure and/or heat to the filter cake in the chamber during said extraction, said applying pressure and/or heat being by inflating envelopes in said filter plates using steam or compressed gas.

According to aspects of the invention, a filter press system for adding solids to and extracting bitumen from a slurry including bitumen-containing sedimentary deposits may comprise: a frame; a plurality of filter plates configured to form a stack of parallel plates, each of the plurality of filter plates being movably attached to the frame, the plurality of filter plates further being configured to form a multiplicity of chambers, each of the multiplicity of chambers being formed by adjacent filter plates of the plurality of filter plates, each of the multiplicity of chambers being lined by filter cloths, wherein the plurality of filter plates, the multiplicity of chambers and the filter cloths are configured to allow filtrate to escape from the chambers while retaining solids from the slurry to form a filter cake; a mixing vessel configured to mix additional solids, such as overburden, into the mixture to form a solids-enriched slurry; a transfer mechanism for moving the solids-enriched slurry from the mixing vessel to the multiplicity of chambers; and a heater for heating filter cake in the multiplicity of chambers. The mixing vessel may be an elongated drum rotatable about its longitudinal axis, the longitudinal axis being at roughly 45 degrees to the horizontal—an example of a suitable mixing vessel being a cement mixer. Furthermore, a vacuum pump may be connected to the multiplicity of chambers to assist in removal of filtrate from the filter cake in the chambers. A flare system may be attached to the exhaust of the vacuum pump for burning-off flammable vapors, particularly flammable vapors generated during vacuum processing. Yet furthermore, the filter plates may be configured with envelopes for applying pressure and/or heat to the filter cake in the chamber during said extraction, said applying pressure and/or heat being by inflating envelopes in said filter plates using steam or compressed gas.

Although the above described methods and systems have been described as being for extracting bitumen from a slurry including bitumen-containing sedimentary material, these methods and systems include a dewatering of the slurry. The above methods and systems may be applied simply for dewatering slurries, including MFTs from oil sands mining and mining in general, without the requirement for bitumen extraction. For example, according to further aspects of the invention, a method of dewatering mine tailings in a filter press may comprise: providing a water-based slurry including mine tailings; pumping the slurry into a chamber between two filter plates in the filter press to form a filter cake, wherein the chamber is lined by filter cloths, and wherein, during the pumping, filtrate is forced through the filter cloths and out of the chamber; heating the filter cake in the chamber, wherein, during the heating, filtrate is forced through the filter cloths and out of the chamber; and releasing dried filter cake from said chamber. During the heating, the chamber may be vacuum pumped to facilitate removal of filtrate vapor. During vacuum processing a flare may be ignited on the exhaust of the vacuum pump to burn-off flammable vapors, if required. The heating may be by steam applied to envelopes in the filter plates. The process may further include applying pressure to the filter cake in the chamber during said heating, said applying pressure being by inflating the envelopes in the filter plates using steam or compressed gas. The slurry may include MFTs. The method may further comprise adding a flocculating/coagulating agent to the slurry and stirring to form a chemically processed solids-enriched slurry, before pumping the slurry into the filter press. Furthermore, the method may include adding additional solids to the slurry to form a solids-enriched slurry before pumping the slurry into the filter press, where the additional solids may include overburden from the mine, wherein the overburden may contain sand and/or dry "swelling" clay.

Although examples of bitumen extraction have been given above, sometimes bitumen containing deposits may also include, or be contaminated with paraffins, asphaltenes, etc. which may not be desired in the extracted bitumen. In order to avoid extracting paraffins during the bitumen extraction process the temperature and pressure needs to be maintained below that at which the paraffins are also extracted—this will generally limit the bitumen extraction process to lower temperatures and pressures.

Note that dissolved salts accumulate in process water used in bitumen extraction processes as it is recycled. However, filter presses may be used to remove these salts when required, as described in U.S. Patent Application Publication No. 2011/0186417 to Simpson et al., incorporated by reference in its entirety herein.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. A method of extracting bitumen from a bitumen-containing sedimentary material using organic solvents comprising:

providing a water-based slurry of bitumen-containing sedimentary material;

pumping said water-based slurry into a chamber between two filter plates in a filter press to form a filter cake, wherein said chamber is lined by filter cloths, and wherein, during said pumping, filtrate is forced through said filter cloths and out of said chamber, said filtrate including bitumen dissolved in water; and pumping solvent through said filter cake to dissolve said bitumen and carry dissolved bitumen away in an effluent wherein said providing further comprises adding non-bitumen containing solids to said slurry, and wherein said non-bitumen containing solids includes overburden from the mining of said bitumen-containing sedimentary material.

2. The method as in claim 1, further comprising, during said pumping solvent, heating said filter cake in said chamber.

3. The method as in claim 2, further comprising, during said heating and said pumping solvent, exposing said chamber to a vacuum, wherein a vacuum pump is connected to said chamber.

4. The method as in claim 3, further comprising, during said exposing, burning-off flammable vapors at the exhaust of said vacuum pump.

5. The method as in claim 1, further comprising, after said pumping solvent, exposing said filter cake to water and vacuum for removal of residual solvent from said filter cake.

6. The method as in claim 5, wherein said water is steam.

7. The method as in claim 1, wherein said slurry includes mine tailings.

8. The method as in claim 1, further comprising, during said pumping solvent, applying pressure and heat to said filter cake in said chamber.

9. The method as in claim 8, wherein said applying pressure and heat comprises inflating envelopes in said filter plates using steam.

10. The method as in claim 1, further comprising, during said pumping solvent, applying pressure to said filter cake in said chamber.

11. The method as in claim 10, wherein said applying pressure comprises inflating envelopes in said filter plates using compressed gas.

12. The method as in claim 1, wherein said filter plates are formed of cross-linked polyethylene.

13. The method as in claim 1, wherein said filter cloths are formed of stainless steel mesh.

14. The method as in claim 1, wherein said solvent is natural gas condensate.

15. The method as in claim 1, wherein said slurry is provided preheated above ambient temperature.

16. The method as in claim 1, wherein said overburden includes sand and dry swelling clay.

17. A method of extracting bitumen from a bitumen-containing sedimentary material using water in a filter press, comprising:

providing a slurry of bitumen-containing sedimentary material;

pumping said slurry into a chamber between two filter plates in said filter press to form a filter cake, wherein said chamber is lined by filter cloths, and wherein, during said pumping, filtrate is forced through said filter cloths and out of said chamber; and pumping water through said filter cake, said water dissolving bitumen from said bitumen-containing sedimentary material, and carrying away dissolved bitumen in an effluent;

wherein said method of extracting bitumen does not utilize flowing a solvent through said bitumen-containing sedimentary material held in said filter-press.

18. The method as in claim 17, wherein said water is hot liquid water.

19. The method as in claim 17, wherein said water is steam, at a pressure greater than 15 psi.

20. The method as in claim 17, further comprising, separating oil-based substances from water in said effluent.

21. A solvent-free method of extracting bitumen from bitumen containing material in a filter press, comprising:

providing a water-based slurry including said bitumen containing material;

pumping said water-based slurry into a chamber between two filter plates in said filter press to form a filter cake, wherein said chamber is lined by filter cloths, and wherein, during said pumping, filtrate is forced through said filter cloths and out of said chamber, said filtrate including bitumen dissolved in water;

heating said filter cake in said chamber, wherein, during said heating, filtrate is forced through said filter cloths and out of said chamber; and processing said filtrate to separate bitumen from water;

wherein said solvent-free method of extracting bitumen does not utilize flowing a solvent through said bitumen-containing material held in said filter-press.

22. The method as in claim 21, further comprising, during said heating, exposing said chamber to a vacuum to facilitate removal of filtrate vapor, wherein a vacuum pump is connected to said chamber.

23. The method as in claim 21, wherein said slurry is a chemically processed solids enriched slurry, said chemically processed solids enriched slurry being formed by adding a flocculating agent to said water-based slurry including tailings.

24. The method as in claim 21, wherein said bitumen containing material includes mine tailings.

25. The method as in claim 21, wherein said bitumen containing material includes crushed mined deposit.

26. The method as in claim 21, further comprising, pumping water through said filter cake, said water dissolving bitumen from said bitumen-containing sedimentary material, and carrying away dissolved bitumen in an effluent.

27. The method as in claim 1, wherein said providing a water-based slurry of bitumen-containing sedimentary material comprises crushing a bitumen-containing sedimentary material and combining the crushed bitumen-containing sedimentary material with water.

28. The method as in claim 1, further comprising, applying pressure to said filter cake in said chamber while blowing compressed air through said filter cake for removing filtrate from said filter cake.

29. The method as in claim 28, wherein said applying pressure to said filter cake comprises inflating envelopes in said filter plates.

30. The method as in claim 1, further comprising, applying pressure to said filter cake in said chamber while pulling a vacuum on said filter cake.

31. The method as in claim 30, wherein said applying pressure to said filter cake comprises inflating envelopes in said filter plates.

32. The method as in claim 1, wherein said adding non-bitumen containing solids to said slurry comprises combining said slurry and said non-bitumen containing solids in a low shear mixing vessel.

33. The method as in claim 21, wherein said providing a water-based slurry of bitumen-containing sedimentary material comprises crushing a bitumen-containing sedimentary material and combining the crushed bitumen-containing sedimentary material with water.

* * * * *